United States Patent [19]

Mooberry et al.

[11] Patent Number: 4,840,884

[45] Date of Patent: Jun. 20, 1989

[54] PHOTOGRAPHIC ELEMENT AND PROCESS COMPRISING A DYE RELEASING GROUP

[75] Inventors: Jared B. Mooberry; Stephen P. Singer, both of Rochester, N.Y.

[73] Assignee: Eastman Kodak Company, Rochester, N.Y.

[21] Appl. No.: 109,371

[22] Filed: Oct. 19, 1987

[51] Int. Cl.[4] ..... G03C 7/18; G03C 7/32; G03C 7/36

[52] U.S. Cl. ..... 430/557; 430/203; 430/385; 430/387; 430/389; 430/543; 430/553; 430/555; 430/558; 430/559

[58] Field of Search ..... 430/203, 385, 387, 389, 430/553, 555, 557, 558, 559, 543

[56] References Cited

U.S. PATENT DOCUMENTS

| | | | |
|---|---|---|---|
| 3,443,939 | 5/1969 | Bloom et al. . | |
| 3,443,940 | 5/1969 | Bloom et al. . | |
| 3,808,945 | 5/1974 | Matsuo et al. | 430/553 |
| 4,248,962 | 2/1981 | Lau | 430/382 |
| 4,409,323 | 10/1983 | Sato et al. | 430/544 |
| 4,439,513 | 3/1984 | Sato et al. | 430/203 |
| 4,458,012 | 7/1984 | Ito et al. | 430/549 |
| 4,474,867 | 10/1984 | Naito et al. | 430/203 |
| 4,483,914 | 11/1984 | Naito et al. | 430/203 |
| 4,507,380 | 3/1985 | Naito et al. | 430/203 |
| 4,584,267 | 4/1986 | Masukawa et al. | 430/203 |
| 4,606,991 | 8/1986 | Kawata et al. | 430/203 |
| 4,663,273 | 5/1987 | Van de Sande et al. | 430/563 |

FOREIGN PATENT DOCUMENTS

| | | |
|---|---|---|
| 0174873 | 3/1968 | European Pat. Off. . |
| 0173302 | 7/1983 | European Pat. Off. . |
| 61272741 | 6/1981 | Japan . |
| 61200539 | 7/1984 | Japan . |
| 61-156047 | 10/1987 | Japan . |

*Primary Examiner*—Paul R. Michl
*Assistant Examiner*—Mark R. Buscher
*Attorney, Agent, or Firm*—Richard E. Knapp

[57] ABSTRACT

A new photographic coupler comprises a coupling-off group bonded to the coupler at the coupling position represented by the formula:

$$-L-NR^1-DYE$$

wherein L is a linking group; $NR^1$ is a substituted nitrogen atom bonded to DYE that together with $NR^1$ is a releasable dye comprising an electrically neutral chromophore. Such a coupler enables dye hue stabilization without mordanting the dye formed. Such a new coupler is useful in a photographic silver halide element and process to provide increased dye density, higher contrast dye images, and lower pH sensitivity upon processing.

10 Claims, No Drawings

PHOTOGRAPHIC ELEMENT AND PROCESS COMPRISING A DYE RELEASING GROUP

FIELD OF THE INVENTION

This invention relates to new photographic couplers that contain a new coupling-off group that releases a dye having an electrically neutral chromophore during photographic processing and to photographic elements and processes using such couplers.

DESCRIPTION OF THE STATE OF THE ART

Various ways are recognized in the photographic art for release of a photographically useful group (PUG) from couplers. Various photographically useful groups are also known for release from such couplers. For example, U.S. Pat. No. 4,248,962 describes compounds that release a photographically useful group by means of an intramolecular nucleophilic displacement reaction in photographic materials. Other examples are described in U.S. Pat. No. 4,409,323, wherein couplers are described that release a photographically useful group by means of an electron transfer down a conjugated chain. These compounds provide a degree of control over the timing and rate of release as well as the rate of diffusion and distance of diffusion of the photographically useful group.

Couplers that have a dye as the PUG, such as a diffusion-resistant dye or a dye precursor, attached through a linking group to the coupler at the coupling position are also known. Such couplers are described in, for example, U.S. Pat. No. 4,248,962 and European Published Patent Application 173,302. Such couplers in the course of photographic processing enable the formation of two dyes, for example an azamethine dye derived from the coupler moiety and a dye released from the coupling-off group. Such couplers can be described as one-equivalent coupler because theoretically the ratio of dye molecules produced to molecules of silver halide reduced in the photographic development process is one.

One-equivalent couplers have advantages, such as dye density enhancement. However, the dyes that have been released from the coupling-off group in such couplers, such as in U.S. Pat. No. 4,248,962, have been anionic dyes that require a mordant to stabilize the dyes in their proper hue. The need for such a mordant is a problem that is troublesome because the mordant leads to undesired effects such as stain caused by the retention in the mordant of sensitizing dyes from photographic silver halide.

As a result of this problem, a continuing need has existed for a new low-equivalent coupler that avoids the need for a mordant for the released dye while providiang dyes that have stable dye hue and enable increased dye density and increased image contrast.

SUMMARY OF THE INVENTION

The present invention provides a photographic element comprising a support, at least one photographic silver halide emulsion layer and at least one coupler (A) having a coupling-off group bonded to the coupler at the coupling position wherein the coupling-off is represented by the formula:

$$-L-\overset{R^1}{\overset{|}{N}}-DYE$$

wherein

L is a cleavable linking group containing —B— bonded to $$-\overset{R_1}{\overset{|}{N}}-$$

wherein —B— is $$-O-\underset{\underset{O}{\|}}{C}-,\ -O-\underset{\underset{S}{\|}}{C}-,\ -S-\underset{\underset{O}{\|}}{C}-,\ \text{or}\ -S-\underset{\underset{S}{\|}}{C}-;$$

and $$\overset{R^1}{\overset{|}{N}}$$

is a substituted nitrogen atom bonded to DYE that together with $NR^1$ is a releasable dye comprising an electrically neutral chromophore.

A new coupler having such a coupling-off group within this formula (a) enables formation, for example, of a dye that needs no mordant to stabilize the dye formed; (b) enables formation of increased dye density in the photographic element; (c) enables reduced pH sensitivity of the photographic element and process containing the coupler; (d) enables an increase in contrast leading to improved images through use of higher concentrations of image modifying compounds in the photographic element; and, (e) enables lower concentrations of silver halide in the photographic element without lowering image quality.

The term electrically neutral regarding the DYE moiety herein means the chromophore at its characteristic hue bears no formal electrical charge. The chromophore may be part of a molecule that does contain ionic sites for solubilization or other purposes.

The term chromophore herein means the color forming portion of a molecule as in, for example, the dye art and the photographic art, suchas "Chemistry of Organic Compounds" by Carl R. Noller, W. B. Sanders Co., Philadelphia and London, 1952, pages 618–619 and ÞThe Theory of the Photographic Process", 4th Edition, 1977, pages 194–199.

One embodiment of the invention is a photographic element comprising a new photographic coupler as described. Another embodiment is a process of forming a photographic image by developing an exposed photographic element by means of a color developing agent in the presence of a new photographic coupler as described. A further embodiment is a new coupler represented by the structure:

$$COUP-L-NR^1-DYE$$

wherein:

COUP is a coupler moiety;

L is a linking group; and $NR^1$ is a substituted nitrogen atom bonded to DYE that enables dye hue stabilization without mordanting the dye formed.

The coupling-off group contains a linking group L that is at least divalent with at least one end bonded to the defined substituted nitrogen atom and the other end bonded to the coupling position of the coupler moiety. The reaction of the coupler with oxidized color developing agent cleaves the bond between the linking group (L) and the coupling position of the coupler moiety. Then the bond between the nitrogen atom and the linking group L is cleaved to release the nitrogen atom and the DYE moiety. The electrically neutral —NR[1]—DYE is then released.

The nitrogen atom in —NR[1]— that is attached to the linking group L is optionally located in an auxochrome, that is a group that intensifies the color of the dye, or it is optionally an integral part of the dye chromophore.

Illustrative groups wherein the described substituted nitrogen atom bonded to L is an auxochrome are as follows:

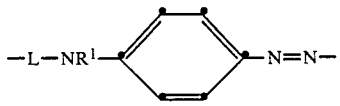

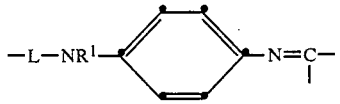

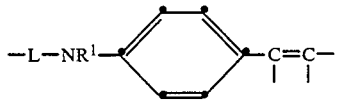

Other illustrative groups wherein the described substituted atom bonded to L is an integral part of the dye chromophore are as follows:

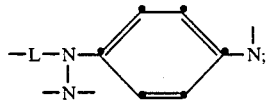

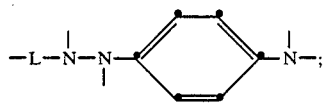

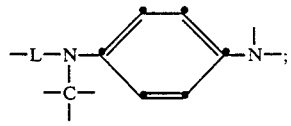

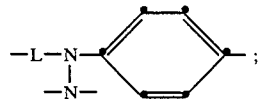

Coupler (A) enables increases dye density, higher contrast dye images and low pH sensitivity upon processing without loss in image sharpness, granularity, and balanced color reproduction without deleterious effects on photographic speed and sensitometric curve shape.

In a photographic element requiring release of the —NR[1]—DYE as described, the release mechanism can be initiated by any means that initiates cleavage of L from the coupler moiety. Depending on the particular coupler, the particular L group, the particular —NR[1]— group and the desired end use of the DYE, the release mechanism can be initiated by, for example, oxidized reducing agent.

As used herein the terms "coupler" and "coupler compound" refer to the entire compound, including the coupler moiety (COUP), the L group, the —NR[1]— group and the DYE, while the term "coupler moiety" refers to that portion of the compound other than the L group, the —NR[1]— group and the DYE.

The particular linking group L can be varied to help control such parameters as rate and time of release of the —NR[1]—DYE group. The particular linking group L employed, including the nature of the substituents on L, can additionally control the rate and distance of diffusion of the unit formed by the group L, the —NR[1]— group and the DYE after this unit is released from the coupler moiety but before the —NR[1]—DYE is released. The linking group L preferably causes a spectral shift in absorption of DYE as a function of attachment to —NR[1]—. Also, the linking group L preferably stabilizes the DYE to oxidation, particularly wherein the —NR[1]— is part of the chromophore.

The coupler moiety COUP can be any moiety which will react with oxidized color developing agent to cleave the bond between the linking group and the coupler moiety. It includes coupler moieties employed in conventional color-forming couplers which yield colorless products on reaction with oxidized color developing agents as well as coupler moieties which yield colored products on reaction with oxidized color developing agents. Both types of coupler moieties are well known to those skilled in the art.

The coupler moiety can be unballasted or ballasted with an oil-soluble or fat-tail group. It can be monomeric, or it can form part of a dimeric, oligomeric or polymeric coupler, in which case more than one —L—NR[1]—DYE unit can be contained in the coupler.

It will be appreciated that, depending upon the particular coupler moiety, the particular color developing agent and the type of processing, the reaction product of the coupler moiety and oxidized color developing agent can be: (1) colored and nondiffusible, in which case it will remain in the location where it is formed; (2) colored and diffusible, in which case it may be removed during processing from the location where it is formed or allowed to migrate to a different location; or (3) colorless.

The —L—NR[1]—DYE unit is joined to the coupler moiety at any of the positions from which groups released from couplers by reaction with oxidized color developing agent can be attached. The —L—NR[1]—DYE unit is attached at the coupling position of the coupler moiety so that upon reaction of the coupler with oxidized color developing agent the —L—NR[1]—DYE will be displaced.

The linking group L can be any organic group which will serve to connect COUP to the —NR[1]— group and which, after cleavage from COUP will cleave from the —NR[1]— group, for example by an elimination reaction of the type described in, for example, U.S. Pat. No. 4,409,323. The elimination reaction involves electron transfer down a conjugated chain. As used herein the term "electron transfer down a conjugated chain " is understood to refer to transfer of an electron along a chain of atoms in which alternate single bonds and double bonds occur. A conjugated chain is understood to have the same meaning as commonly used in organic chemistry. Electron transfer down a conjugated chain is as described in, for example, U.S. Pat. No. 4,409,323.

The group L can contain moieties and substituents which will permit control of one or more of the following rates: (i) the rate of reaction of COUP with oxidized color developing agent, (ii) the rate of diffusion of —L—NR[1]—DYE and (iii) the rate of release of DYE. The linking group L can contain additional substituents or precursors thereof which may remain attached to the linking group or be released.

Illustrative linking groups include:

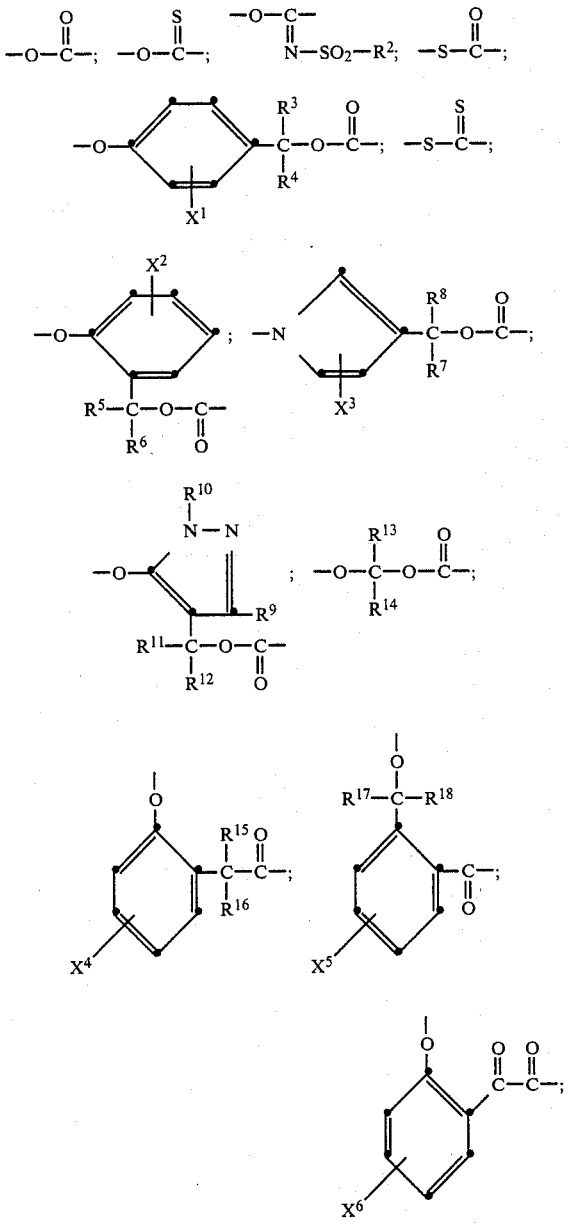

wherein $X^1$ through $X^6$ and $R^1$ through $R^{18}$ are substituents that do not adversely affect the described COUP—L—NR[1]—DYE. For example, $R^1$ through $R^{18}$ are individually hydrogen, unsubstituted or substituted alkyl, such as alkyl containing 1 to 30 carbon atoms, for example, methyl, ethyl, propyl, n-butyl, t-butyl, pentyl and eicosyl; or cycloalkyl, such as cyclopentyl, cyclohexyl and 4-methoxycyclohexyl; or aryl, such as unsubstituted or substituted phenyl. $X^1$ through $X^6$ can be hydrogen or a substituent that does not adversely affect the described COUP—L—NR[1]—DYE, such as electron withdrawing or donating groups, for example, alkyl, such as methyl, ethyl, propyl, n-butyl, t-butyl and eicosyl, halogen, such as chlorine and bromine, nitro, carbamyl, acylamido, sulfonamido, sulfamyl, sulfo, carboxyl, cyano, and alkoxy, such as methoxy and ethoxy, acyl, sulfonyl, hydroxy, alkoxycarbonyl, and aryloxy. The linking group L can be, for example, a linking group within U.S. Pat. No. 4,409,323 or a nucleophilic displacement type linking group as described in, for example, U.S. Pat. No. 4,248,962, or a linking group which is a combination of these two types.

A particularly useful linking group is represented by the formula:

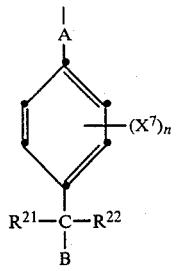

wherein

A is O, S, or sulfonamido ($N—SO_2R^{23}$);

B is

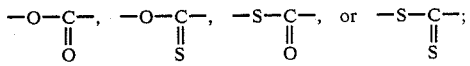

$R^{21}$ and $R^{22}$ are individually hydrogen, or substituted or unsubstituted alkyl, such as methyl, ethyl, propyl, n-butyl or t-butyl, or aryl, such as unsubstituted or substituted phenyl; $X^7$ is a substituent as described for $X^1$, that does not adversely affect the coupler; and n is 0, 1, 2, 3 or 4. $R^{23}$ is a substituent, typically alkyl or aryl. Typically $R^{21}$ and $R^{22}$ are hydrogen.

Preferred linking groups include:

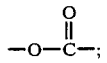

and

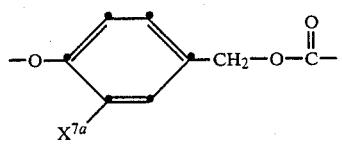

wherein $X^{7a}$ is hydrogen, chlorine, methylsulfonamido ($NHSO_2CH_3$), $—COOCH_3$, $—NHCOCH_3$, $—CONHCH_3$, $—COHNCH_2COOH$, —COOH or $CON(CH_3)_2$.

A particularly useful linking group is represented by the formula:

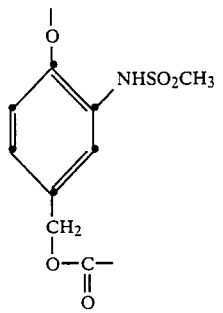

The linking group and DYE optionally contain substituents that can modify the rate of reaction, diffusion, or displacement, such as halogen, including fluoro, chloro, bromo, or iodo, nitro, alkyl of 1 to 20 carbon atoms, acyl, carboxy, carboxyalkyl, alkoxycarbonyl, alkoxycarbonamido, alkylcarbamyl, sulfoalkyl, alkylsulfonamido, and alkylsulfonyl, solubilizing groups, ballast groups and the like. For example, solubilizing groups will increase the rate of diffusion and ballast groups will decrease the reate of diffusion.

The $R^1$ substituent on —$NR^1$— can be any substituent that does not adversely affect the coupler (A). When the —$NR^1$— is part of an auxochrome, $R^1$ can be, for example, hydrogen or alkyl, such as alkyl containing 1 to 30 carbon atoms, including methyl, ethyl, propyl, n-butyl, t-butyl or eicosyl, or aryl, such as phenyl. When the nitrogen atom attached to L is part of a chromophore, $R^1$ becomes an integral part of the chromophore.

Preferred $R^1$ groups are alkyl, such as alkyl containing 1 to 18 carbon atoms when $R^1$ is part of the dye auxochrome. $R^1$ when part of the chromophore is, for example, unsubstituted or substituted aryl, such as phenyl.

The DYE as described includes any releasable, electrically neutral dye that enables dye hue stabilization without mordanting the dye formed. The release mechanism can be initiated by oxidized reducing agent.

The particular DYE and the nature of the substituents on the DYE can control whether or not the dye diffuses and the rate and distance of diffusion of the DYE formed. For example, the DYE can contain a ballast group known in the photographic art that hinders or prevents diffusion. The DYE can contain a water solubilizing group, such as a carboxy group, to help diffusion of the DYE. Such groups are known to those skilled in the art.

Particularly useful classes of DYE moieties are:

I. Azo dye moieties including the —$NR^1$— group represented by the structure:

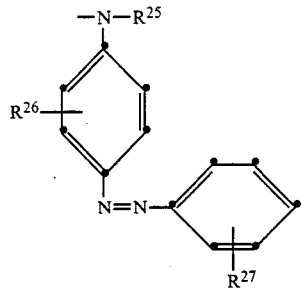

wherein $R^{25}$, $R^{26}$ and $R^{27}$ are individually hydrogen or a substituent, such as alkyl.

II. Azamethine dye moieties including the —$NR^1$— group represented by the structure:

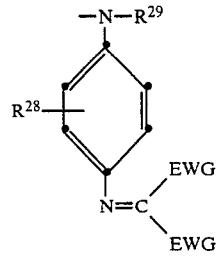

wherein $R^{28}$ is hydrogen or a substituent, such as alkyl; $R^{29}$ is hydrogen or a substituent, such as alkyl; and EWG is an electron withdrawing group.

III. Methine dye moieties including the —$NR^1$— group represented by the structure:

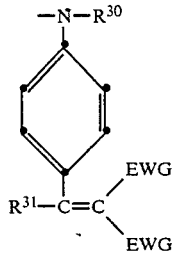

wherein $R^{30}$ is hydrogen or a substituent, such as alkyl; $R^{31}$ is hydrogen or a substituent such as alkyl; and EWG is an electron withdrawing group.

The term DYE also includes dye precursors wherein the described substituted nitrogen atom is an integral part of the chromophore, also described herein as leuco dye moieties. Such dye precursors include, for example,:

IV.

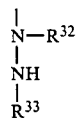

wherein $R^{32}$ and $R^{33}$ are aryl, such as substituted phenyl.

V.

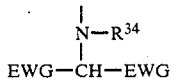

wherein $R^{34}$ is an aryl group, such as substituted phenyl; and EWG is an electron withdrawing group.

VI.

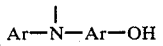

wherein Ar are individually substituted aryl groups, particularly substituted phenyl groups. When the DYE moiety is a leuco dye, L preferably comprises a timing group that enables delay of oxidation of the leuco dye by silver halide in a photographic silver halide element. For example, it is preferred that L be a

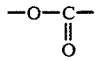

group when DYE is a leuco dye moiety as described.

Examples of cyan, magenta, yellow and leuco dyes are as follows:

A. Cyan

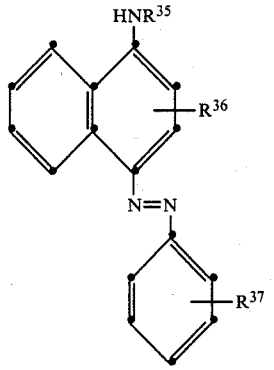

wherein $R^{35}$ is a substituent that does not adversely affect the dye, such as alkyl; $R^{36}$ is a substituent, such as an electron releasing group; and $R^{37}$ *is a substituent, such as a strong electron withdrawing group.*

B. Magenta

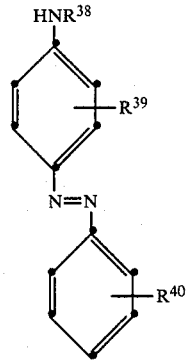

wherein $R^{38}$ is a substituent that does not adversely affect the dye, such as alkyl; $R^{39}$ is a substituent, such as an electron releasing group; and $R^{40}$ is a substituent, such as a strong electron withdrawing group.

C. Yellow

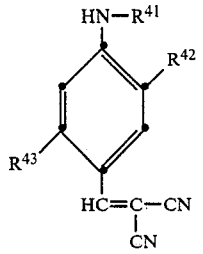

wherein $R^{41}$ is alkyl; $R^{42}$ is alkoxy; and $R^{43}$ is alkyl; and

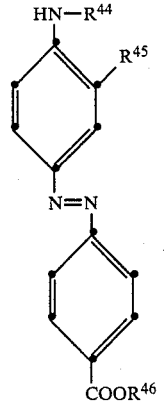

wherein $R^{44}$ is alkyl; $R^{45}$ is alkoxy; and $R^{46}$ is alkyl or aryl.

D. Leuco

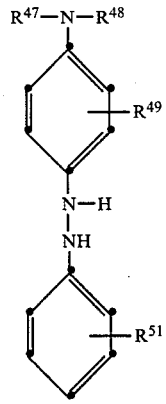

wherein $R^{47}$ and $R^{48}$ are individually hydrogen or alkyl; $R^{49}$ is an electron releasing group; and $R^{51}$ is a strong electron withdrawing group.

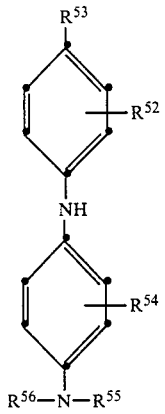

wherein $R^{52}$ and $R^{54}$ are individually hydrogen or a substituent; $R^{53}$ is a hydroxyl, $NHR^a$ or $NHSO_2R^a$ wherein $R^a$ is a substituent; $R^{55}$ and $R^{56}$ are individually hydrogen or a substituent.

A listing of patents and publications which describe representative COUP groups useful in the invention follow. In these structures Y represents —L—NR-$^1$—DYE as defined above.

I. COUP's

A. Couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; and 4,333,999.

Preferably such couplers are phenols and naphthols which form cyan dyes on reaction with oxidized color developing agent and have the —L—NR$^1$—DYE unit attached to the coupling position, i.e. the carbon atom in the 4-position. Structures of preferred such coupler moieties are:

IA-1

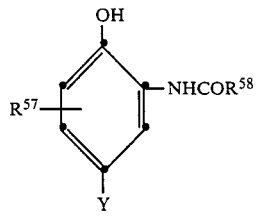

IA-2

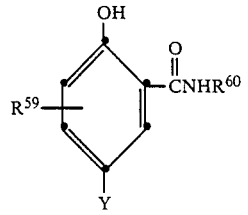

IA-3

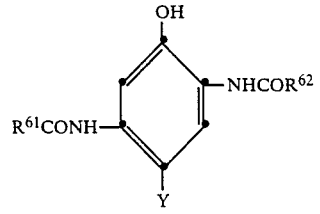

-continued

IA-4

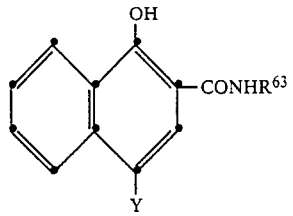

wherein $R^{58}$, $R^{60}$, $R^{61}$, $R^{62}$ and $R^{63}$ represent ballast groups, and $R^{57}$ and $R^{59}$ represent one or more halogen (e.g. chloro, fluoro), lower alkyl (e.g. methyl, ethyl, butyl), lower alkoxy (e.g. methoxy, ethoxy, butoxy) groups, or ballast groups.

B. Couplers which form magenta dyes upon reaction with oxidized color developing agent are described in such representative patents and publications as: U.S. Pat. Nos. 2,600,788; 2,369,489; 3,615,506; 2,343,703; 2,311,082; 3,152,896; 3,519,429; 3,062,653; 2,908,573; European Patent Publications 170,164 and 177,765.

Preferably, such couplers are pyrazolones and pyrazolotriazoles which form magenta dyes upon reaction with oxidized color developing agents and have the Y, i.e. —L—NR$^1$—DYE attached to the coupling position. Structures of preferred such coupler moieties are:

IB-1

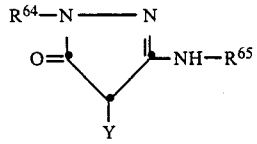

IB-2

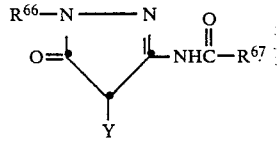

IB-3

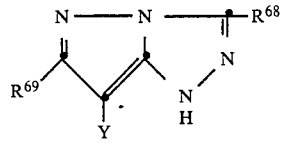

IB-4

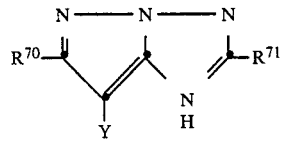

where $R^{64}$ through $R^{71}$ are chosen independently to be a ballast group, unsubstituted or substituted alkyl, or unsubstituted or substituted phenyl.

C. Couplers which form yellow dyes upon reaction with oxidized color developing agent are described in such representative patents and publications as: U.S. Pat. Nos. 2,875,057; 2,407,210; 3,265,506; 2,298,443; 3,048,194; and 3,447,928.

Preferably such yellow-dye forming couplers are acylacetamides, such as benzoylacetanilides and pivalylacetanilides, and have the Y group, i.e., —L—NR$^1$—DYE, attached to the coupling position.

Structures of preferred such coupler moieties are:

IC-1

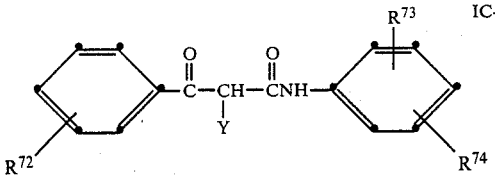

IC-2

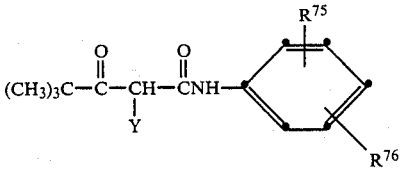

where $R^{74}$ and $R^{76}$ are individually ballast groups and $R^{72}$, $R^{73}$ and $R^{75}$ are individually hydrogen or one or more halogen, lower alkyl, such as methyl and ethyl, alkoxy groups, or ballast groups, such as alkoxy of 16 to 20 carbon atoms.

D. Couplers which form colorless products upon reaction with oxidized color developing agent are described in such representative patents as: U.K. Patent No. 861,138; U.S. Pat. Nos. 3,632,345; 3,928,041; 3,958,993 and 3,961,959. Preferably such couplers are cyclic carbonyl containing compounds which form colorless products on reaction with oxidized color developing agent and have the —L—$NR^1$—DYE unit attached to the carbon atom in the α-position with respect to the carbonyl group.

Structures of preferred such coupler moieties are:

ID-1

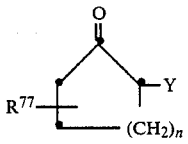

ID-2

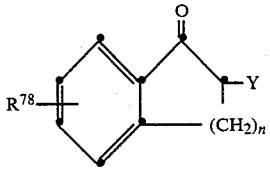

ID-3

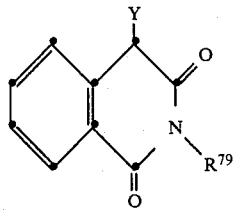

ID-4

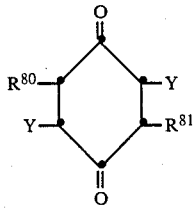

where $R^{77}$ through $R^{81}$ are individually substituted or unsubstituted alkyl, substituted or unsubstituted phenyl or a ballast group and n is 1 or 2.

E. Couplers which form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764.

Preferably such couplers are resorcinols or m-aminophenols which form black or neutral products on reaction with oxidized color developing agent and have the —L—$NR^1$—DYE unit para to a hydroxy group.

Structures of preferred such coupler moieties are:

IE-1

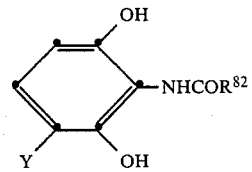

IE-2

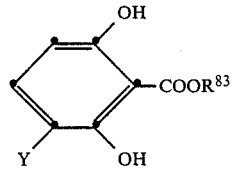

IE-3

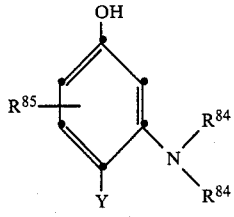

where $R^{82}$ and $R^{83}$ are alkyl of 3 to 20 carbon atoms, unsubstituted phenyl or phenyl substituted with hydroxy, halo, amino, alkyl of 1 to 20 carbon atoms or alkoxy of 1 to 20 carbon atoms; each $R^{84}$ is independently hydrogen, alkyl of 1 to 20 carbon atoms, alkenyl of 1 to 20 carbon atoms, or aryl of 6 to 20 carbon atoms; and $R^{85}$ is one or more halogen, alkyl of 1 to 20 carbon atoms, alkoxy of 1 to 20 carbon atoms or other monovalent organic groups.

The described couplers can be incorporated in photographic elements and/or in photographic processing solutions, such as developer solutions, so that upon development of an exposed photographic elemet they will be in reactive association with oxidized color developing agent. Coupler compounds incorporated in photographic processing solutions should be of such molecular size and configuration that they will diffuse through photographic layers with the processing solution. When incorporated in a photographic element, as a general rule, the coupler compounds should be non-diffusible, that is they should be of such molecular size and configuration that they will not significantly diffuse or wander from the layer in which they are coated.

Photographic elements as described can be processed by conventional techniques in which color forming couplers and color developing agents are incorporated in separate processing solutions or compositions or in the element.

Photographic elements in which the couplers are incorporated can be a simple element comprising a support and a single silver halide emulsion layer or they can be multilayer, multicolor elements. The couplers can be incorporated in at least one of the silver halide emulsion layers and/or in at least one other layer, such as an adjacent layer, where they will come into reactive association with oxidized color developing agent which has developed silver halide in the emulsion layer. The silver halide emulsion layer can contain or have associated with it, other photographic coupler compounds, such as dye-forming couplers, colored masking couplers, and/or competing couplers. These other photographic couplers can form dyes of the same or different hue as the photographic couplers of this invention. Additionally, the silver halide emulsion layers and other layers of the photographic element can contain addenda conventionally contained in such layers.

A typical multilayer, multicolor photographic element according to this invention can comprise a support having thereon a red-sensitive silver halide emulsion unit having associated therewith a cyan dye image providing material, a green-sensitive silver halide emulsion unit having associated therewith a magenta dye image providing material and a blue-sensitive silver halide emulsion unit having associated therewith a yellow dye image-providing material, at least one of the silver halide emulsion units having associated therewith at least one photographic coupler of the invention. Each silver halide emulsion unit can be composed of one or more layers and the various units and layers can be arranged in different locations with respect to one another.

The couplers of this invention can be incorporated in or associated with one or more layers or units of of the photographic element. At least one of the layers of the photographic element can be, for example, a barrier layer.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly in the interior of the silver halide grains. They can be chemically and spectrally sensitized. The emulsions typically will be gelatin emulsions although other hydrophilic colloids are useful. Tabular grain light sensitive silver halides are particularly useful such as described in *Research Disclosure,* January 1983, Item No. 22534 and U.S. Pat. No. 4,434,226.

The support can be any support used with photographic elements. Typical supports include cellulose nitrate film, cellulose acetate film, polyvinylacetal film, polyethylene terephthalate film, polycarbonate film and related films or resinous materials as well as glass, paper, metal and the like. Typically, a flexible support is employed, such as a polymeric film or paper support. Paper supports can be acetylated or coated with baryta and/or an $\alpha$-olefin polymer, particularly a polymer of an $\alpha$-olefin containing 2 to 10 carbon atoms such as polyethylene, polypropylene, ethylene-butene copolymers and the like.

The photographic couplers can be used in photographic elements in the same way as photographic couplers which release dye moieties have previously been used in photographic elements. However, no mordant is required in the photographic elements for the dye formed from —L—NR$^1$—DYE.

Depending upon the particular —L—NR$^1$—DYE, the couplers can be incorporated in a photographic element for different purposes and in different locations.

If the silver halide emulsion unit is composed of more than one layer, one or more of such layers can contain the coupler of this invention. The layers can contain other photographic couplers conventionally used in the art. The coupling reaction using couplers of this invention can form dyes of the same color as the color forming coupler(s) in the layer or unit, or it can form a dye of a different color. Combinations of couplers according to the invention are also useful.

Photographic couplers of this invention can be used in processes where either dye formed is allowed to diffuse to an integral or separate receiving layer to form a desired image. Alternatively, either dye can be retained in the location where it is released to augment the density of the dye formed from the coupler from which it is released or to modify or correct the hue of that dye or another dye. In another embodiment, the dye formed from the coupler moiety can be completely removed from the element and the dye which was not released from the coupler can be retained in the element as a color correcting mask. Couplers accoding to the invention can be prepared by methods known in the organic compound synthesis art. Typically, the couplers of this invention are prepared by, for example, reacting the coupler moiety having an appropriate substituent in the coupling position, such as —OH or

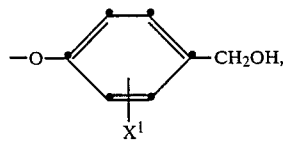

with

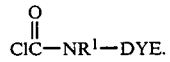

The following examples illustrate the way in which these steps can be performed using specific reactants and reactions.

GENERAL SYNTHETIC ROUTES

Synthesis (a) Phenolic Link:

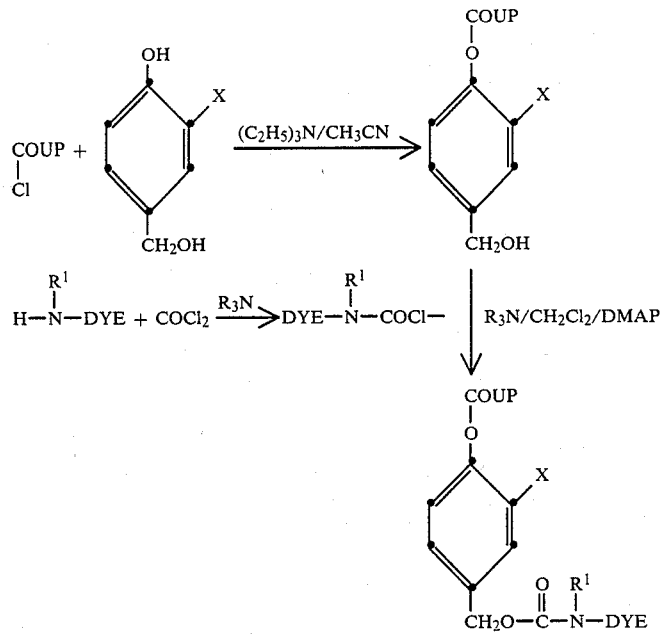
Synthesis (b) Direct Attachment:
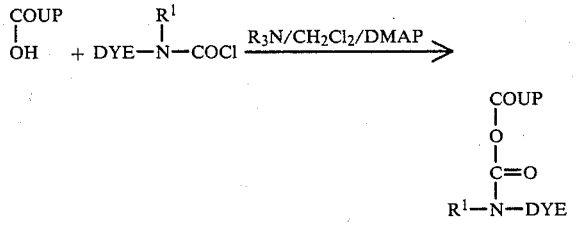
DMAP herein is 4-dimethylaminopyridine. $R_3N$ herein is a trialkylamine, particularly $(C_2H_5)_3N$ or $EtiPr_2N$.
The following is a specific illustrative synthesis of a coupler as described:
Synthesis Example A
Preparation of Compound (I)
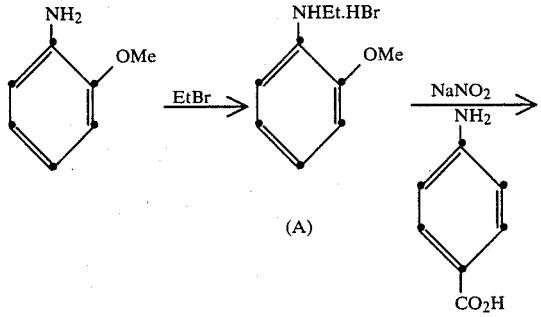
(A)

-continued
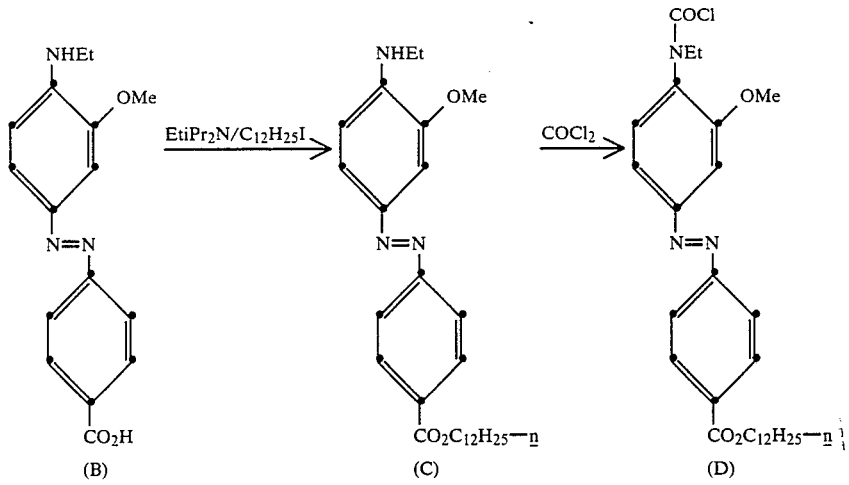
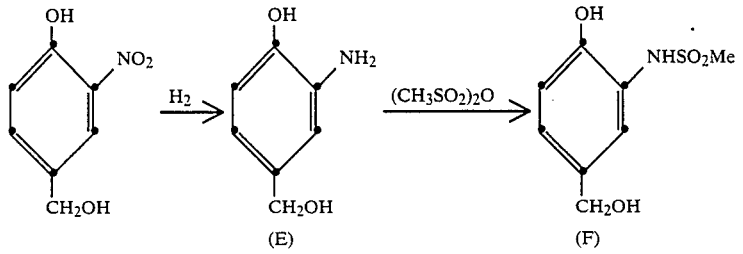
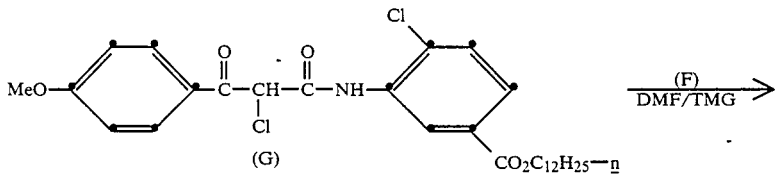
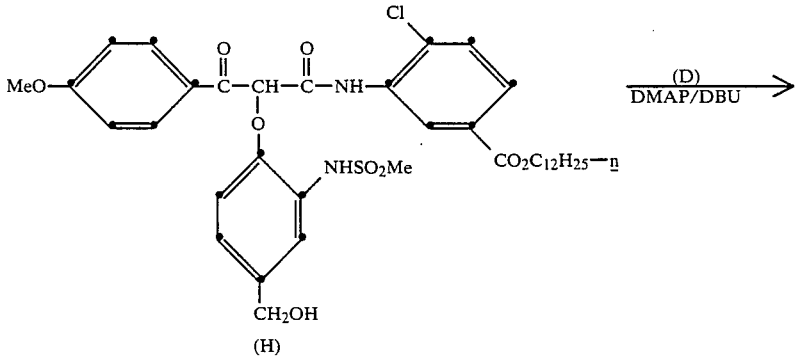

-continued

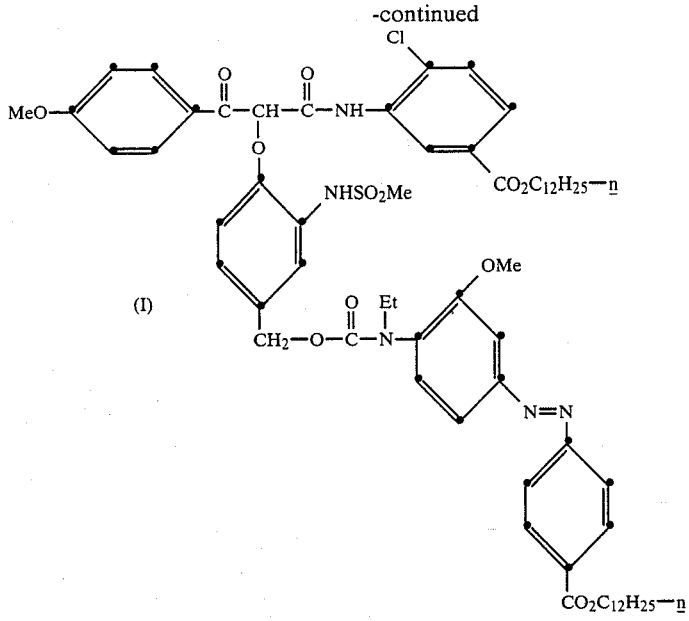

DMF herein is dimethylformamide. TMG herein is 1,1,3,3-tetramethylguanidine. DMAP herein is 4-dimethylaminopyridine. DBU herein is 1,8-diazabicyclo[5.4.0]undec-7-ene. Ether means ethyl ether. $EtiPr_2N$ herein means ethyldiisopropylamine. Me herein means $CH_3$—. Et herein means $C_2H_5$. Temperatures herein are °C. unless otherwise indicated.

Preparation of (A)

Ethyl bromide (500 g, 4.6 mole), o-anisidine (370 g, 3.0 mole), and isopropanol (1l) were refluxed for 16 hours. The hot solution was poured into a container and cooled with ice. The crystalline hydrobromide salt was filtered, washed with cold isopropanol and ether. Recrystallization from a minimum volume of hot isopropanol with cooling at 0° overnight yielded 402 g (58%) of (A).

Preparation of (B)

Water (400 ml), conc. HCl (80 ml), and p-aminobenzoic acid (31.4 g, 0.21 mole) were mixed. After cooling the mixture to 0°, ice (100 g) and sodium nitrite (14.3 g, 0.21 mole) were added. After a few minutes when all of the nitrite had dissolved, a solution of (A) (48.0 g, 0.21 mole) in aqueous HCl (40 ml of conc. HCl, 200 ml of $H_2O$) was slowly added while maintaining the temperature near 0°. Sodium acetate (140 g) was slowly added to promote coupling. After stirring about 30 minutes, the mixture was filtered to obtain a mixture of dye and triazene. The triazene was rearranged to dye by stirring the crude product with acetic acid (about 200 ml) for 2 days at room temperature (20° C.) (or by heating for about 2 hours at 50° ). The dye which precipitated from the acetic acid was filtered off and washed with methanol to yield 41.7 g (67%) of (B).

Preparation of (C)

The acidic dye (B) (41.7 g, 0.14 mole) was esterified by heating with dodecyliodide (45.6 g, 0.15 mole), ethyldiisopropylamine (19.4 g, 0.15 mole), and DMF (200 ml) at 100° for 3 hours. The crude mixture was diluted with ether, washed with 0.05N HCl and water, dried over $MgSO_4$, concentrated to an oil, and crystallized from methanol to yield 44.5 g (68%) of ballasted dye (C).

Preparation of (D)

Ballasted dye (D) (12.3 g, 0.0264 mole) and 2,6-lutidine (3.2 g, 0.03 mole) were dissolved in dichloromethane (200 ml) cooled to about 15°. Phosgene (30 ml of 1M solution in toluene, 0.03 mole) was added slowly before stirring the mixture for 20 minutes. The mixture was washed with cold aqueous 0.05N HCl and ice water before drying over $MgSO_4$. Crude carbamyl chloride (D) was obtained by concentration in vacuo. This was used directly in the reaction to form (I) without further purification.

Preparation of (E)

Commercially available 3-nitro-4-hydroxybenzyl alcohol (16.9 g, 0.1 mole) was hydrogenated at (40 psi) 255.8 Kilo Pascals in dioxane (300 ml) using 1 g of 5% Pd on carbon as catalyst. After the catalyst was filtered off, the solution was concentrated to form (E) as a crystalline solid (10 g, 72%).

Preparation of (F)

Aminophenol (E) (2.78 g, 0.02 mole) and 2,6-lutidine (2.36 g, 0.022 mole) were mixed with p-dioxane (40 ml). Methanesulfonic anhydride (3.48 g, 0.02 mole) was then added. After ½ hour, the mixture was diluted with ethyl acetate and washed twice with salt water (100 ml of saturated NaCl plus 15 ml of 1N HCl). After drying over $MgSO_4$, the ethyl acetate extract was concentrated to a solid residue. Crystallization from ethyl acetate heptane yielded 3.2 g (75%) of product (F).

Preparation of (H)

α-(4-Methoxybenzoyl)-α-chloro-2-chloro-5-dodecyloxycarbamylacetanilide (32.9 g, 0.06 mole) and phenol (F) (13.0 g, 0.06 mole) were dissolved in DMF (200 ml) maintained at 50°–55° under a nitrogen atmosphere. 1,1,3,3-Tetramethyl-guanidine (13.8 g, 0.12 mole) in DMF (65 ml) was added dropwise over 5 minutes. After 3 hours at 50°–60°, the mixture was cooled, diluted with ethyl acetate, washed with 0.02N HCl twice and then with $H_2O$ before drying over $MgSO_4$ and concentrating to an oil. The product (H) crystallized on stirring overnight with a small amount of ethyl acetate. The yield was 18.9 g (45%).

Preparation of (I)

Coupler (H) (18.5 g, 0.0264 mole) and crude dye carbamyl chloride (D) (0.0264 mole) were dissolved in $CH_2Cl_2$ (250 ml) under a nitrogen atmosphere. 4-Dimethylaminopyridine (DMAP, 3.2 g, 0.0264 mole) and 1,8-diazobicyclo[5.4.0]undec-7-ene (DBU, 8.1 g, 0.053 mole) were added before stirring the mixture overnight at room temperature. The mixture was diluted with ether, washed with aqueous HCl and $H_2O$, dried over $MgSO_4$, and concentrated to an oil. This oil was chromatographed on silica gel using heptane:ethyl acetate (3:2). The product (I) (14.5 g, 46%) was crystallized once from heptane and then from acetonitrile.

In each case the compounds were identified by elemental analysis and/or NMR (nuclear magnetic resonance) and/or MS (mass spectra).

The following examples further illustrate the invention.

EXAMPLE 1

This example illustrates that a coupler of the invention provides unexpectedly increased image dye density and increased dye image contrast (gamma) in a color photographic element.

Photographic elements were prepared by coating a cellulose acetate-butyrate film support with a photosensitive layer containing a silver bromoiodide emulsion at 1.08 g/m$^2$, gelatin at 3.77 g/m$^2$, and one of the couplers designated in following Table I dispersed in half its weight of dibutyl phthalate and coated at 6.46 mmol/m$^2$. The photosensitive layer was overcoated with a layer containing gelatin at 2.69 g/m$^2$ and bis-vinylsulfonylmethyl ether at 1.75 weight percent based on total gelatin.

Samples of each element were imagewise exposed through a graduated-density test object and processed at 40° C. employing the following color developing solution, then stopped, bleached, fixed, washed, and dried to produce stepped yellow dye images.

$K_2SO_3$: 2.0 gm,
$K_2CO_3$: 30.0 gm,
KBr: 1.25 gm,
KI: 0.6 mg,
4-Amino-3-methyl-N-ethyl-N-β'-hydroxyethylaniline sulfate: 3.55 gm,
Water to 1.0 liter, pH 10.0.

Densitometry of these images provided measures of maximum density ($D_{max}$). Gamma (contrast) is the maximum slope between any two density points which are two steps apart.

The results are given in following Table 1A.

TABLE 1A

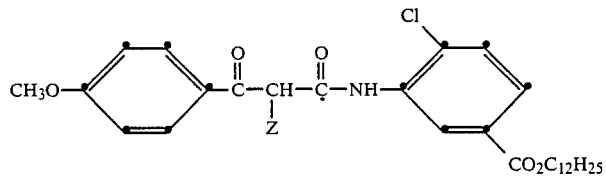

| Coupler | $D_{max}$ | Gamma |
|---|---|---|
| (Invention) 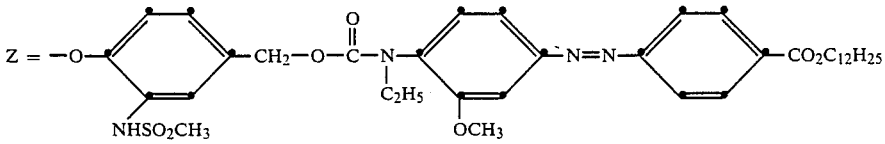 | 2.61 | 2.39 |
| (Comparison A) 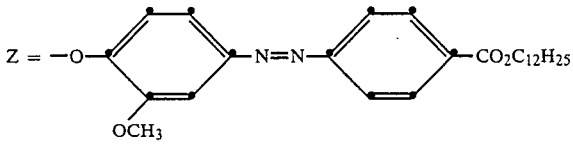 | 0.53 | .21 |
| (Comparison B) 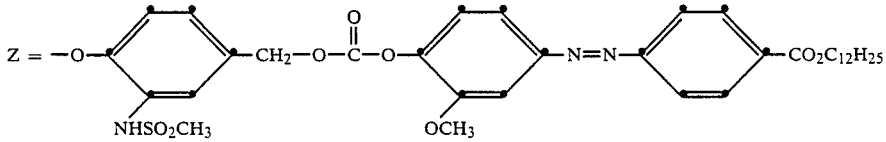 | 1.37 | 1.23 |
| (Comparison C) | 1.31 | .64 |

TABLE 1A-continued
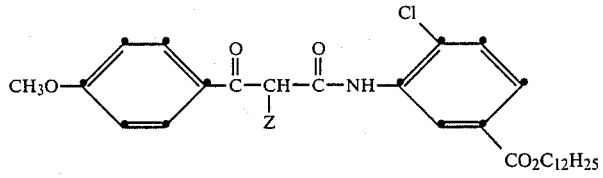
| Coupler | $D_{max}$ | Gamma |
|---|---|---|
| Z = 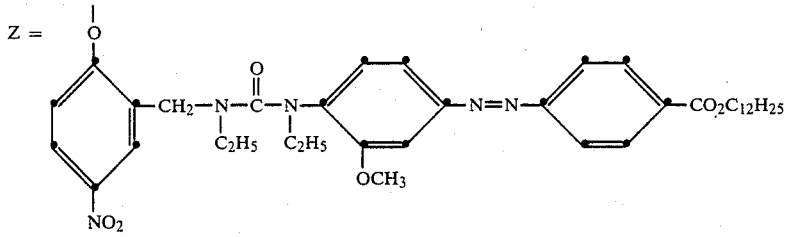 | | |
| (Comparison D) | 1.33 | 1.44 |
| Z = 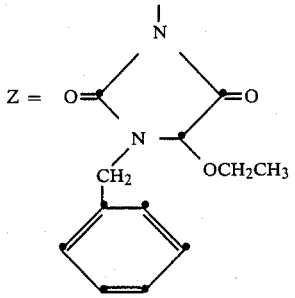 | | |
| (Comparison E) | 1.13 | 1.17 |
| 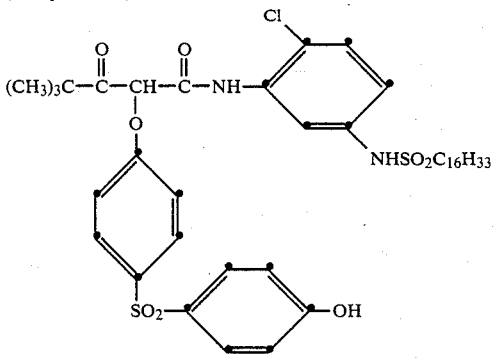 | | |
The following examples can also be prepared using the described procedures of synthesis and can be used in photographic silver halide element as described in Example 1.
EXAMPLE 2

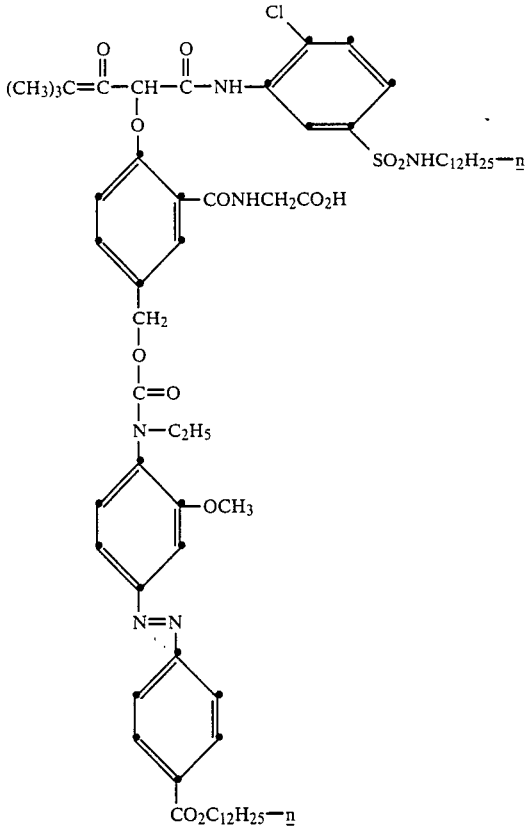
EXAMPLE 3
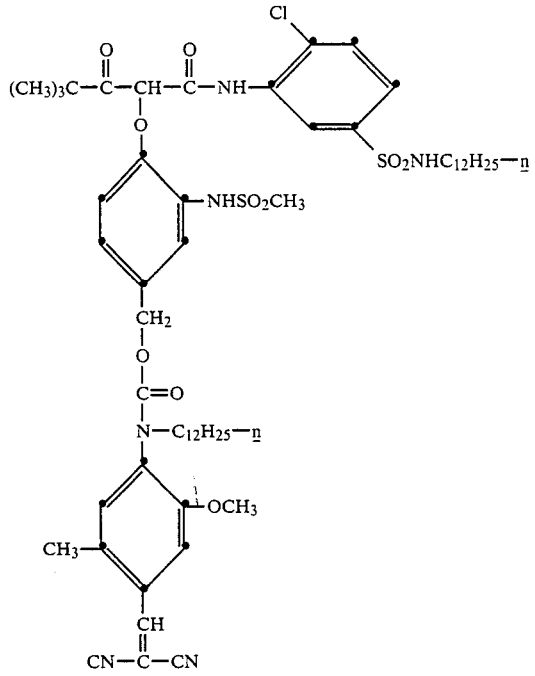
EXAMPLE 4
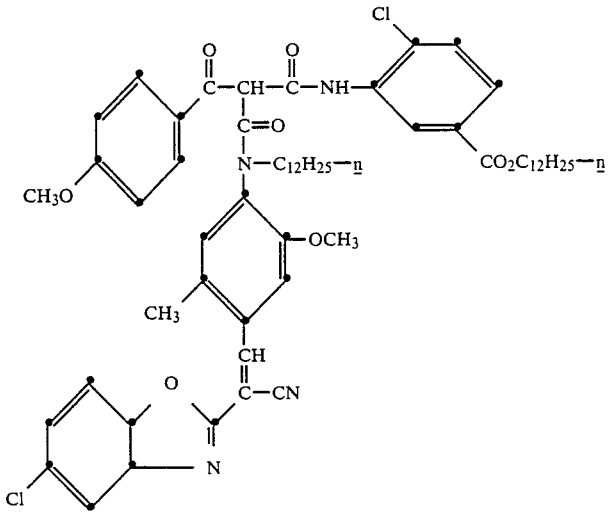

EXAMPLE 5
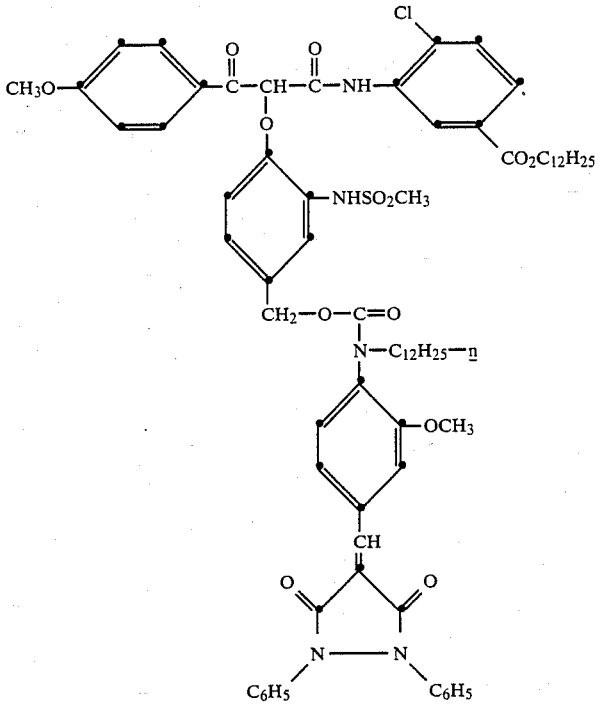
EXAMPLE 6
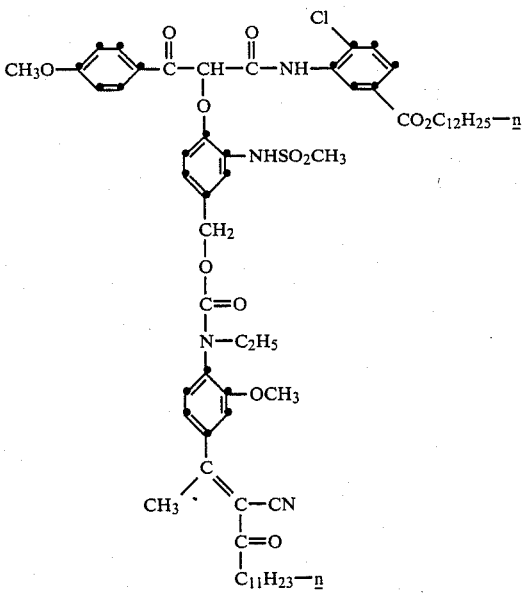
EXAMPLE 7
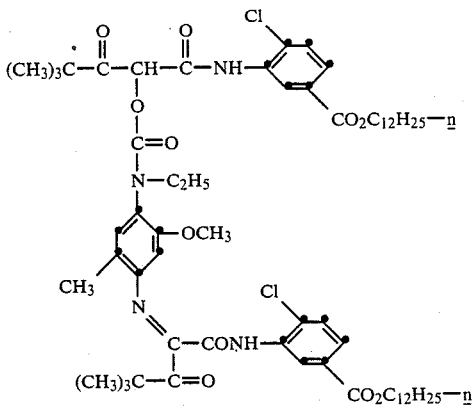
EXAMPLE 8

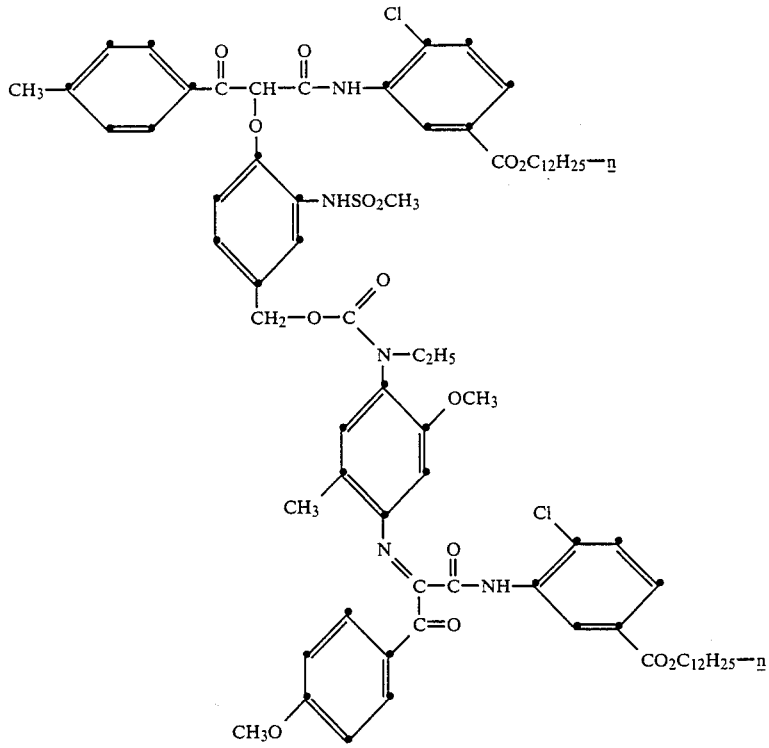
EXAMPLE 9
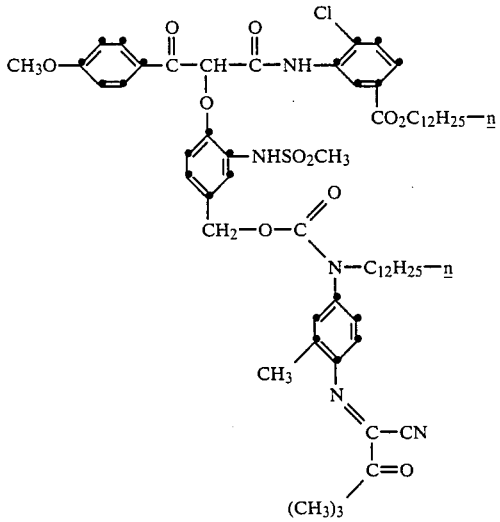
EXAMPLE 10
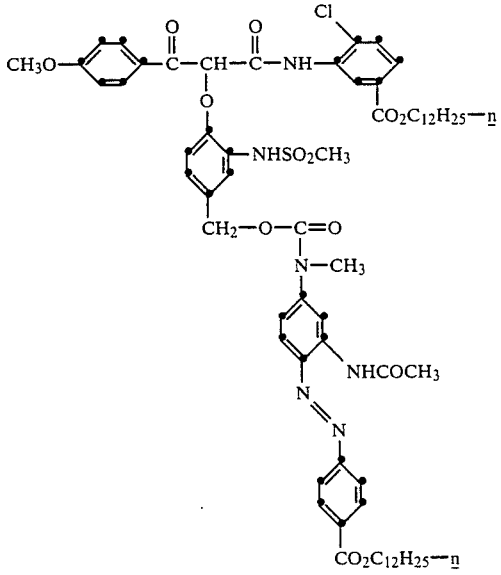
EXAMPLE 11

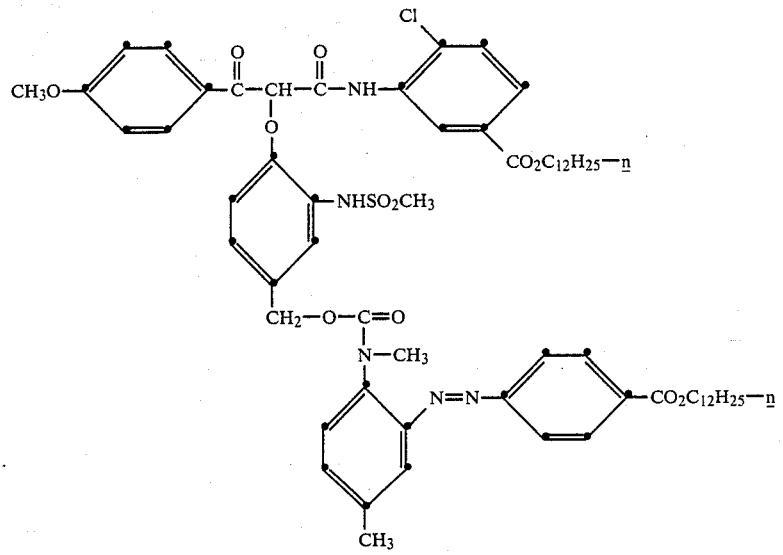
35
EXAMPLE 12
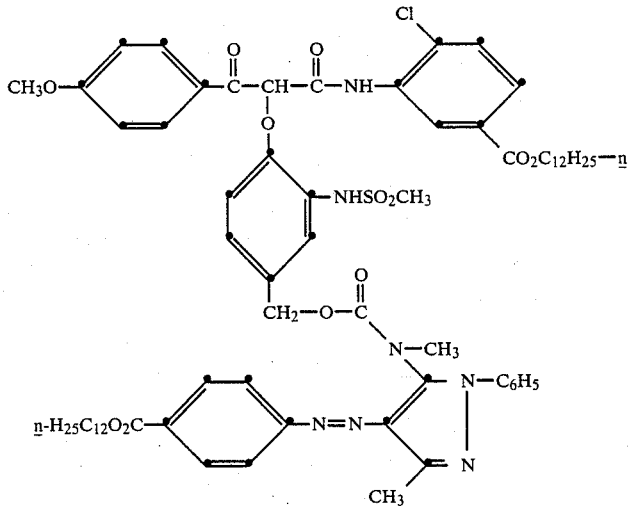

EXAMPLE 13
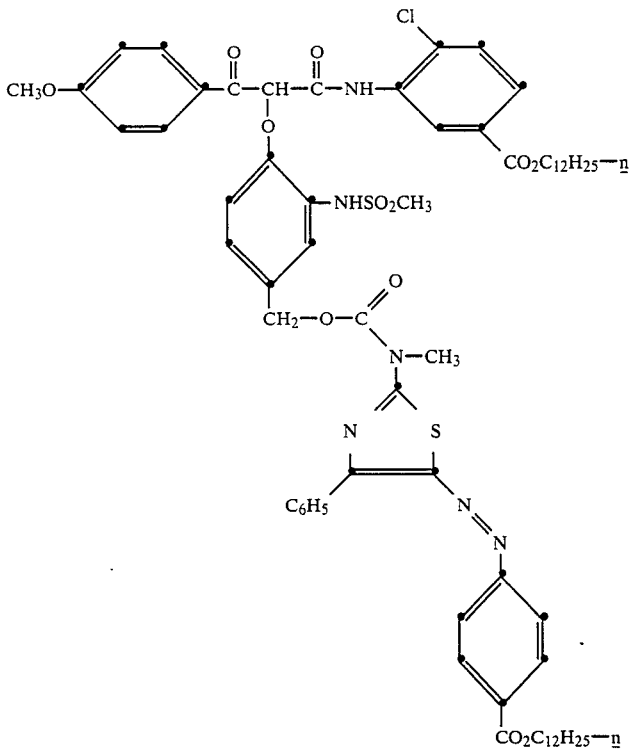
35
EXAMPLE 14
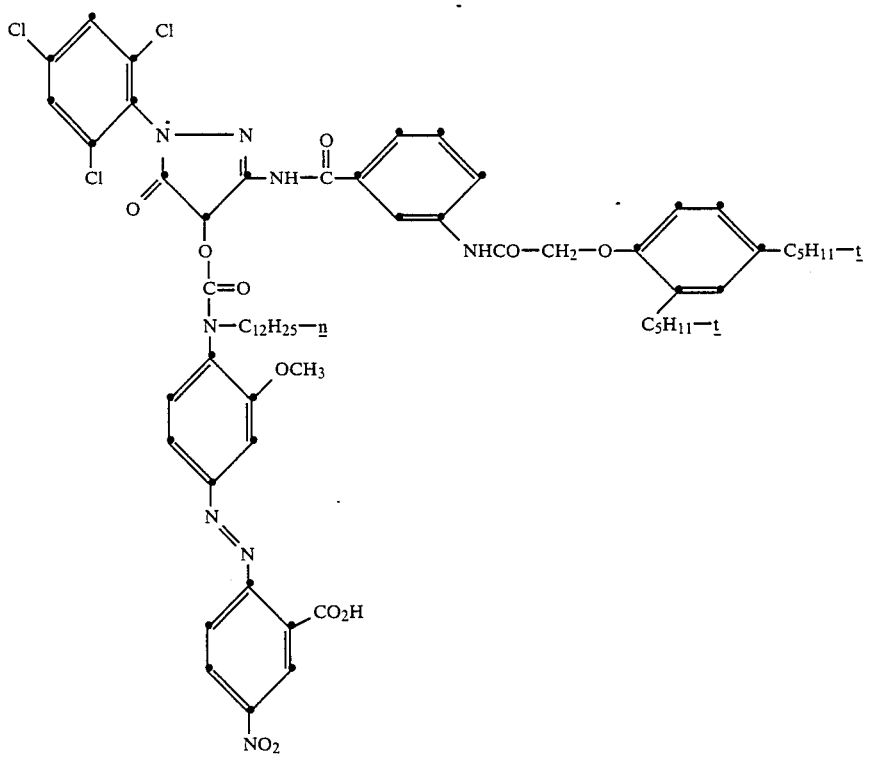

EXAMPLE 15
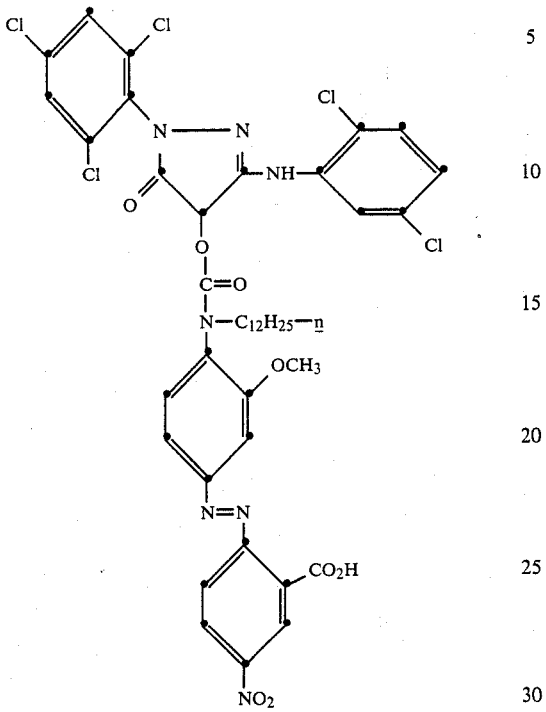
EXAMPLE 16
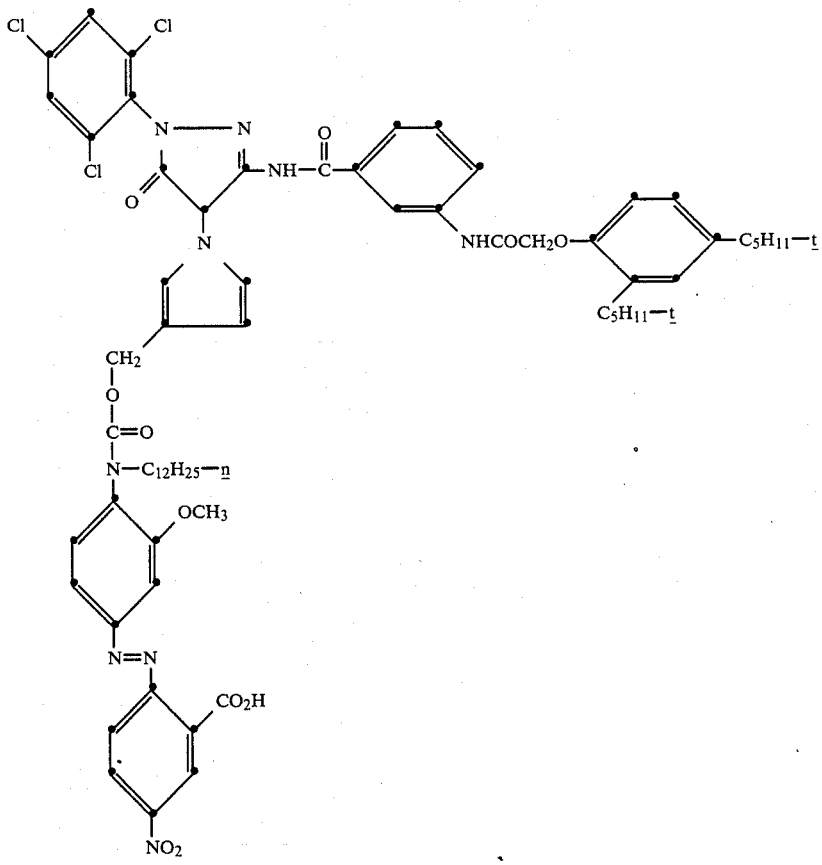
EXAMPLE 17

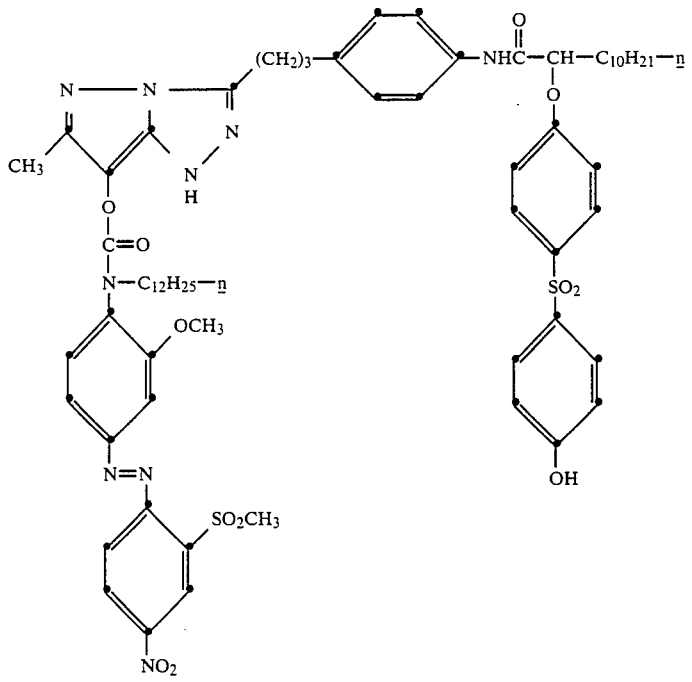
EXAMPLE 18
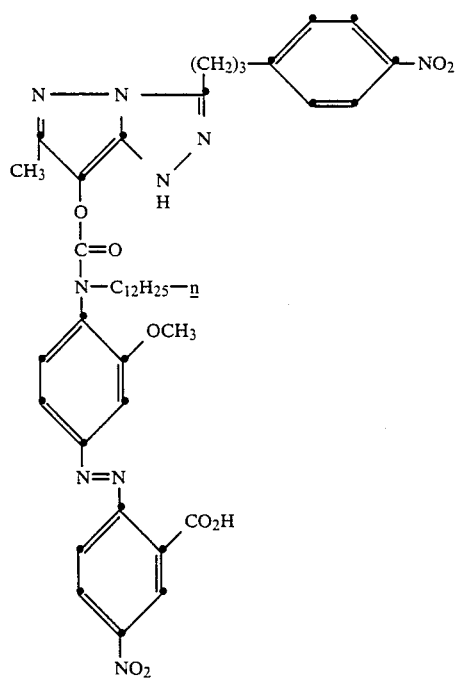
EXAMPLE 19

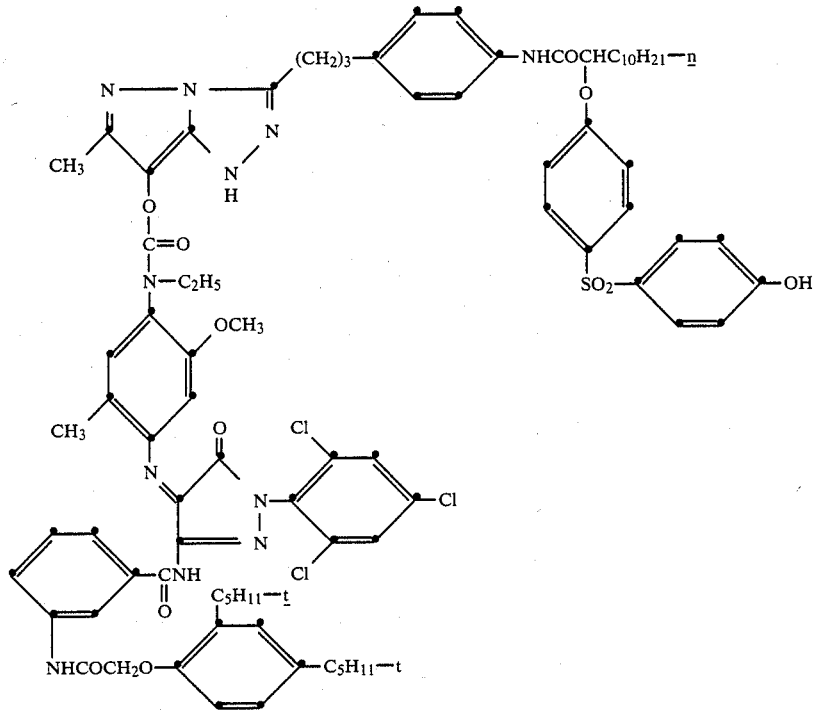
EXAMPLE 20
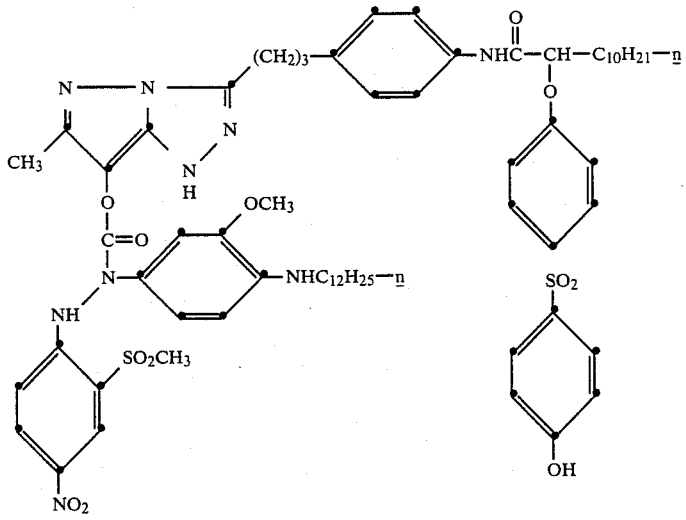

EXAMPLE 21
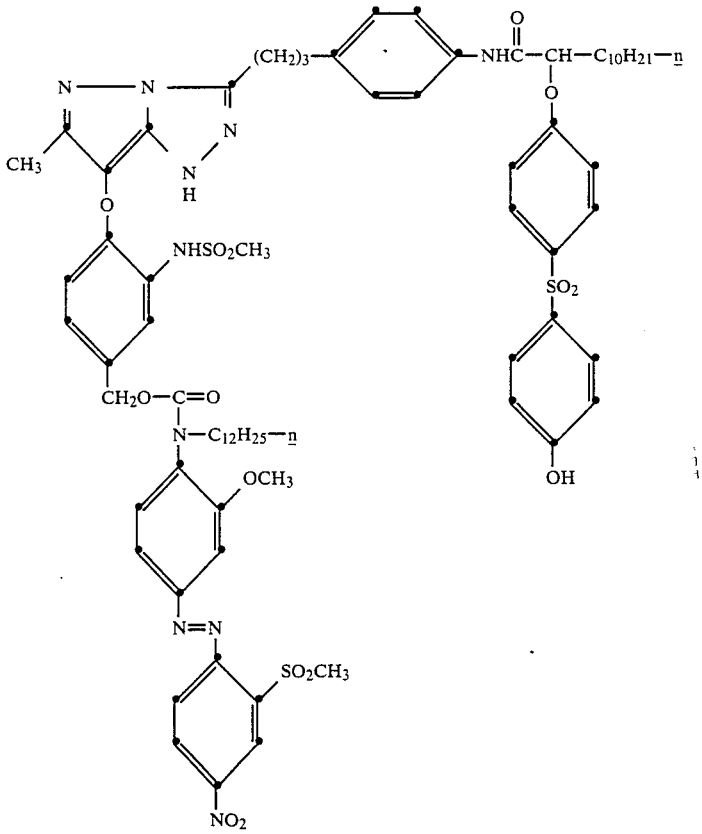
EXAMPLE 22
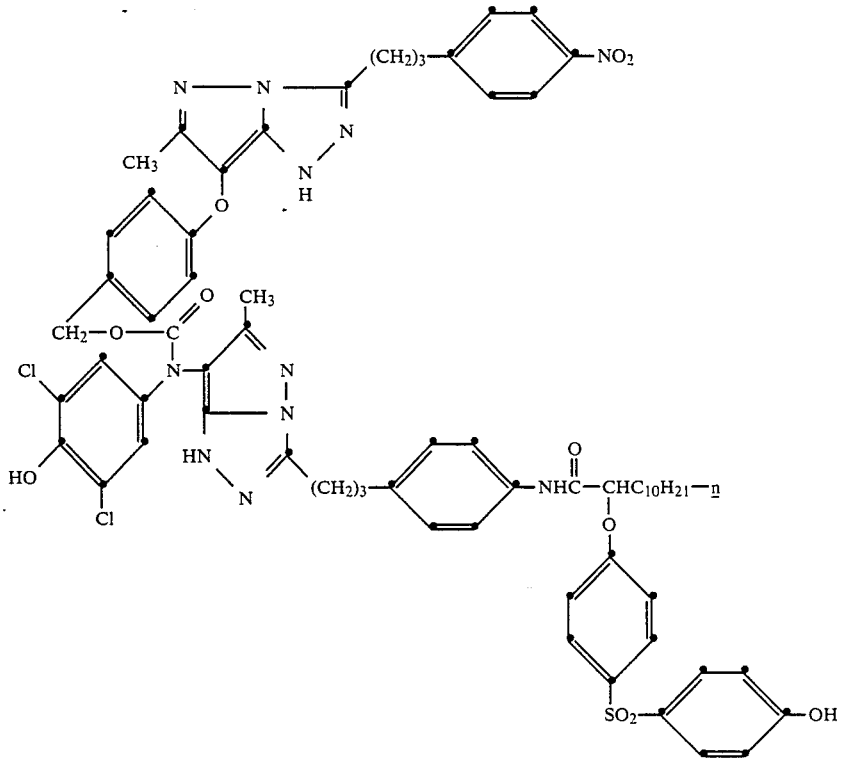

EXAMPLE 23
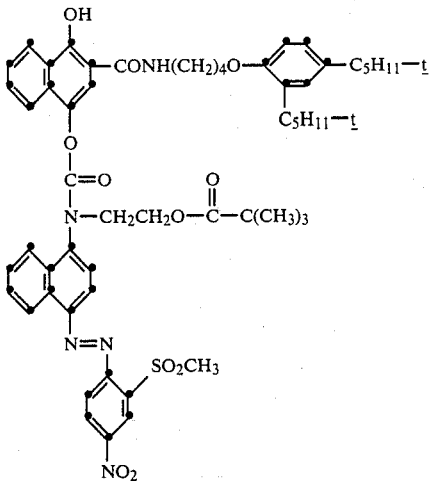
EXAMPLE 24
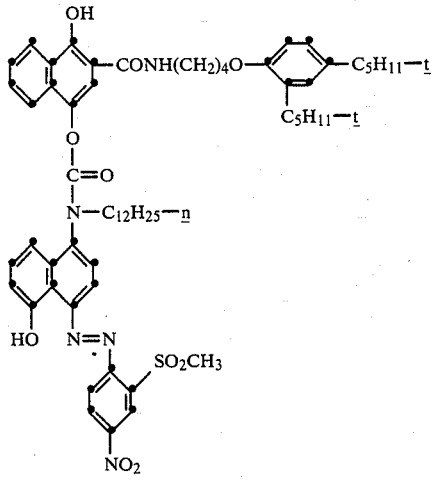
EXAMPLE 25
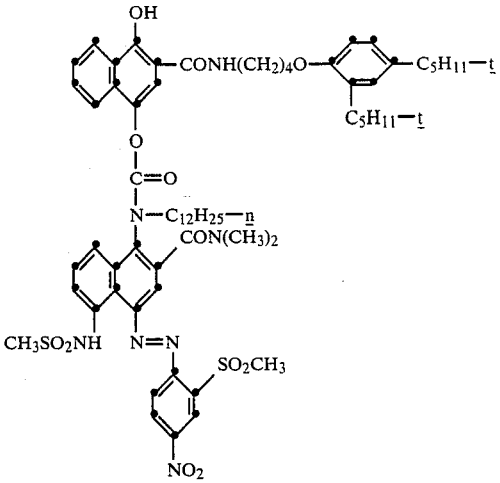
EXAMPLE 26
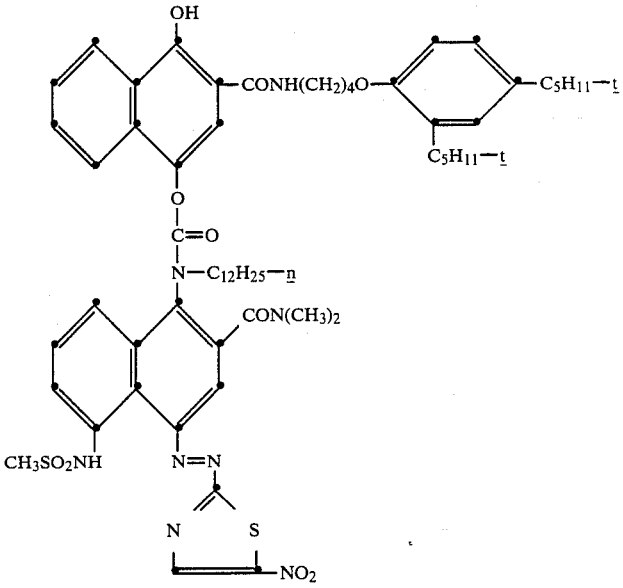
EXAMPLE 27
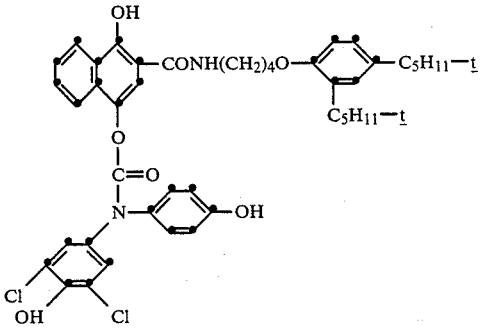

EXAMPLE 28
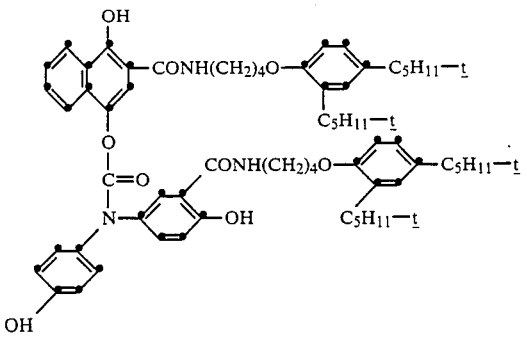
EXAMPLE 29
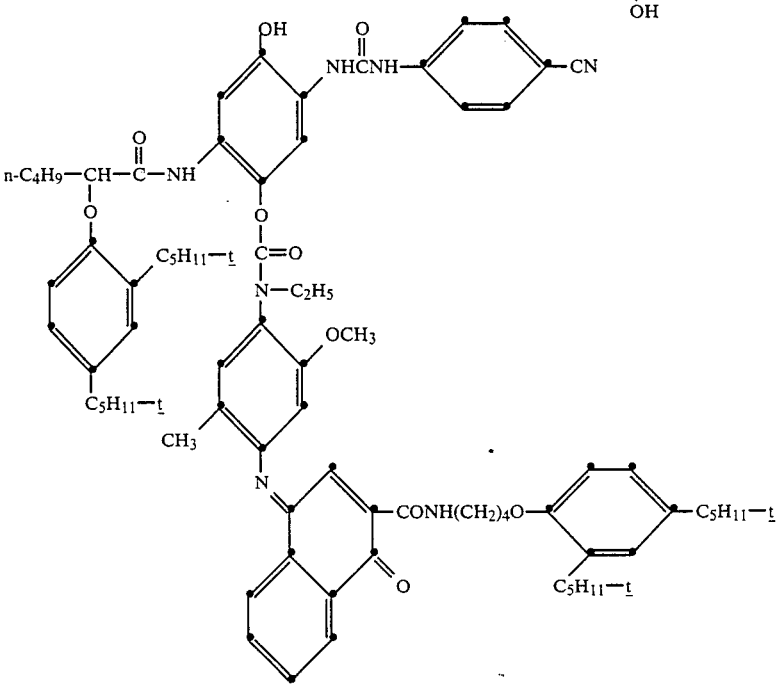
EXAMPLE 30
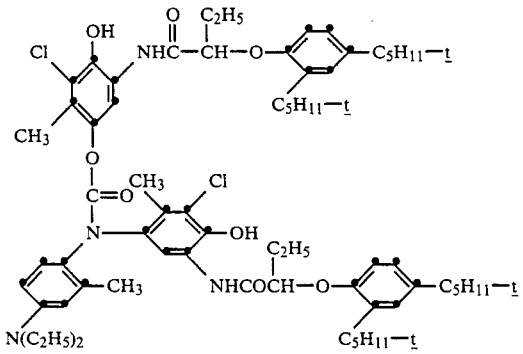
EXAMPLE 31
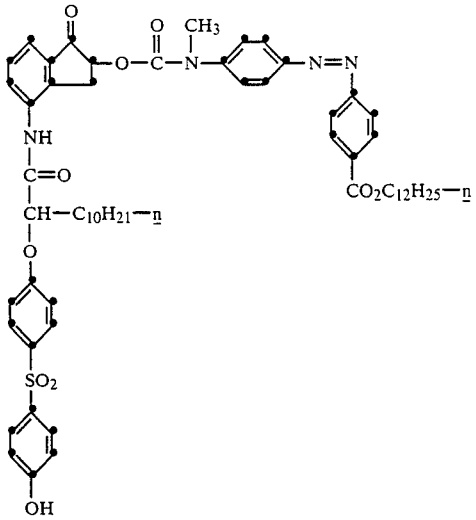

EXAMPLE 32
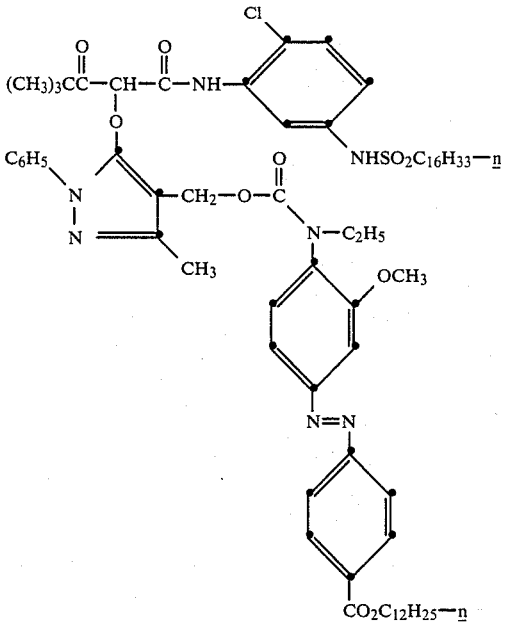
EXAMPLE 33
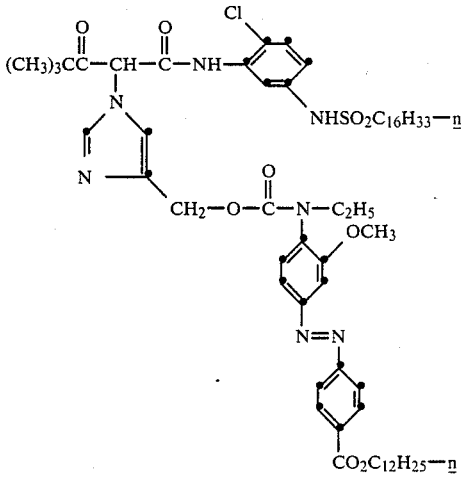
EXAMPLE 34
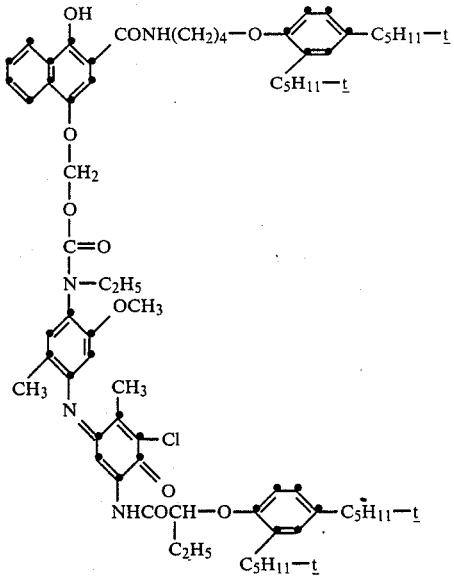
EXAMPLE 35

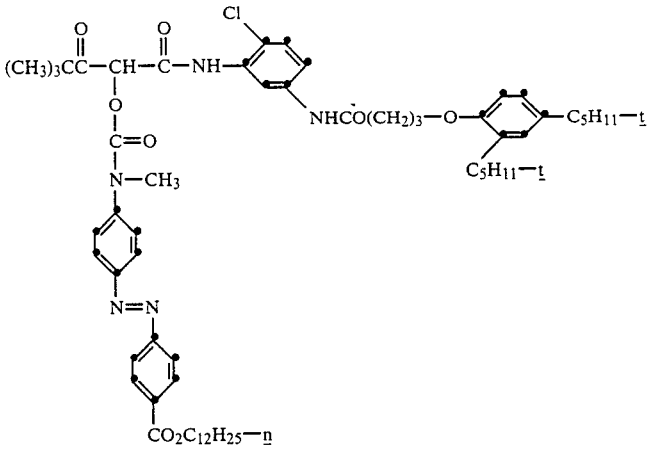
EXAMPLE 36
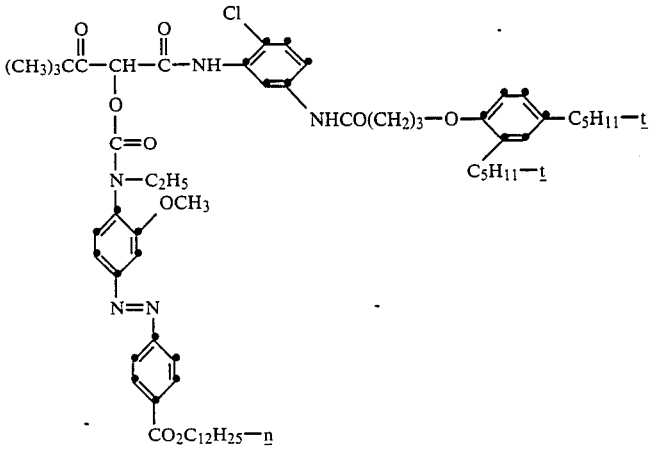
EXAMPLE 37
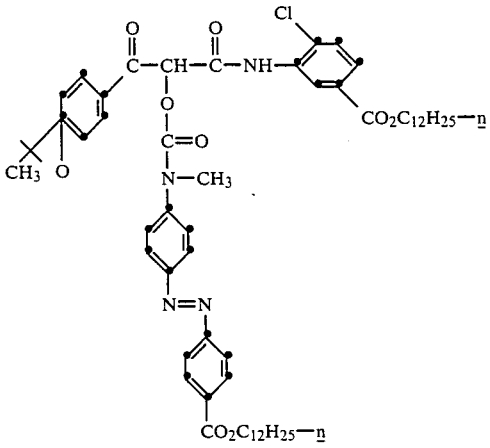
EXAMPLE 38
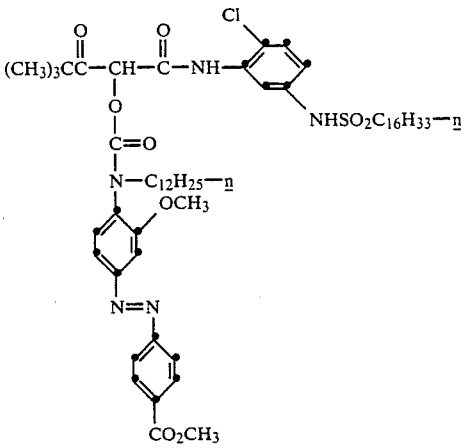

EXAMPLE 39
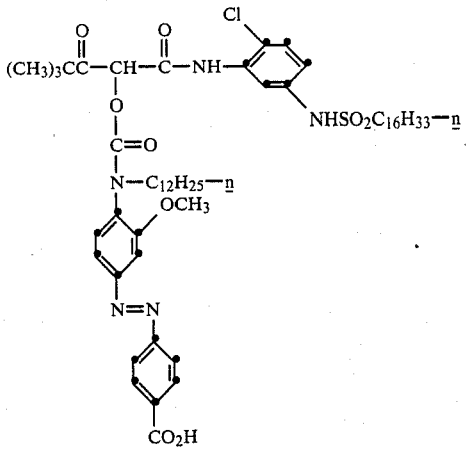
EXAMPLE 40
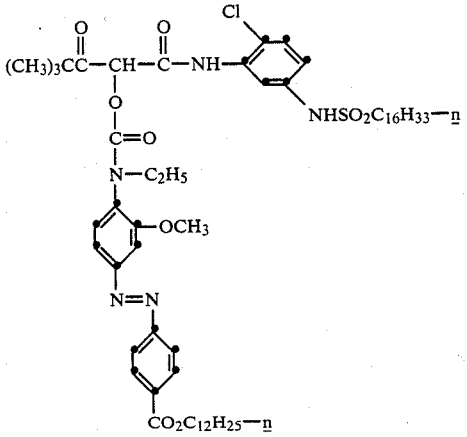
-continued
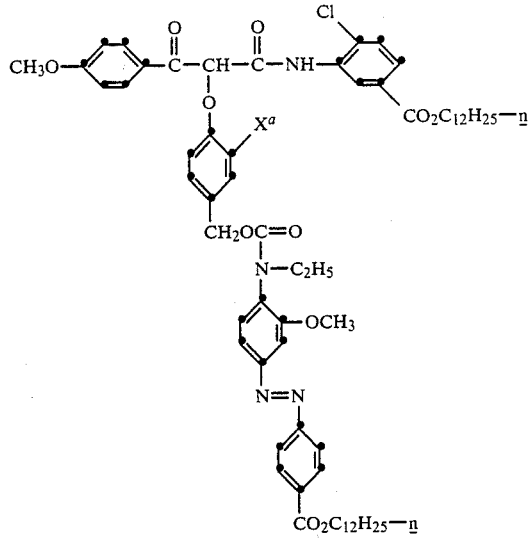
EXAMPLE 41
$X^a = NHCOCH_3$
EXAMPLE 42
$X^a = NHSO_2CH_3$
EXAMPLE 43
$X^a = Cl$
EXAMPLE 44
$X^a = H$
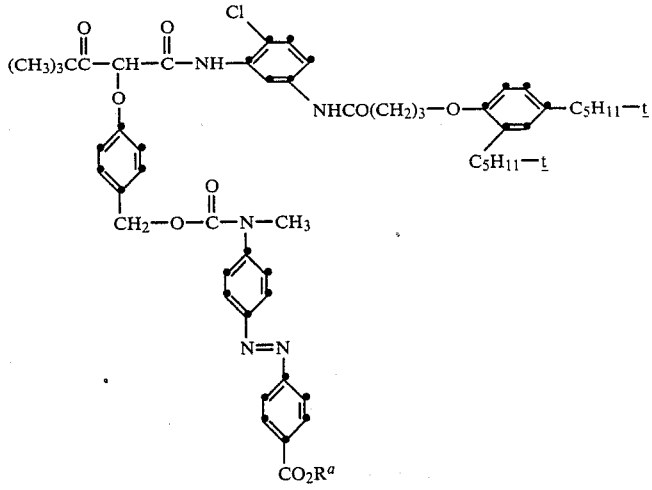
EXAMPLE 45
$R^a = H$
EXAMPLE 46
$R^a = CH_3$
EXAMPLE 47
$R^a = C_{12}H_{25}$-n
EXAMPLE 48

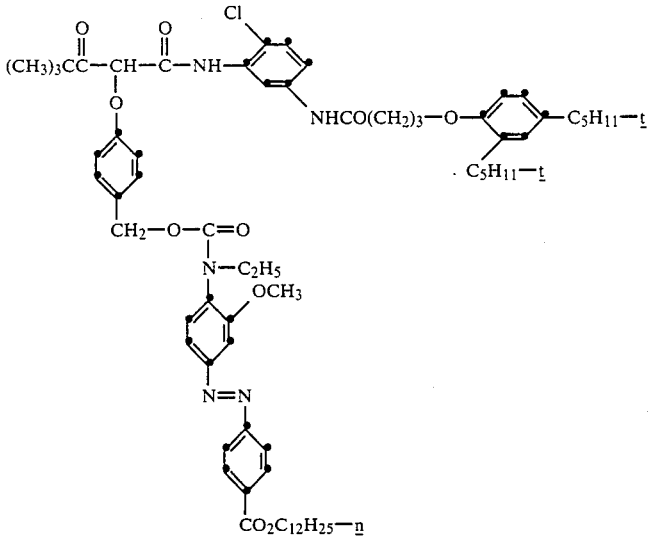
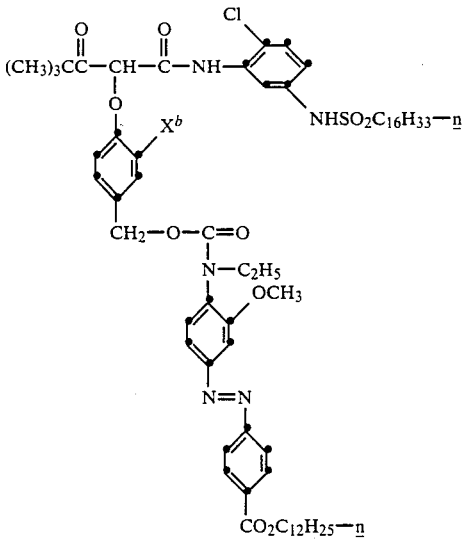
EXAMPLE 49
$X^b$=H
EXAMPLE 50
$X^b$=$NHSO_2CH_3$
EXAMPLE 51

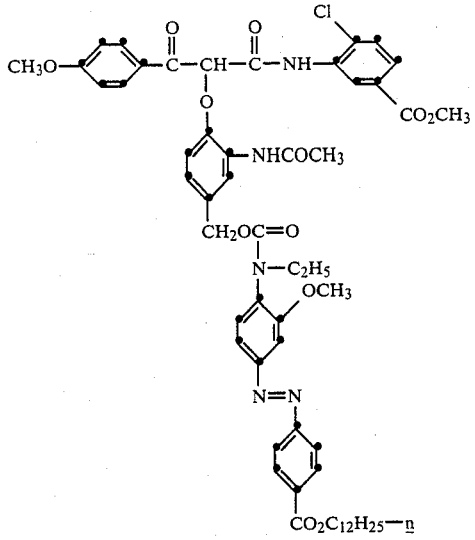
EXAMPLE 53
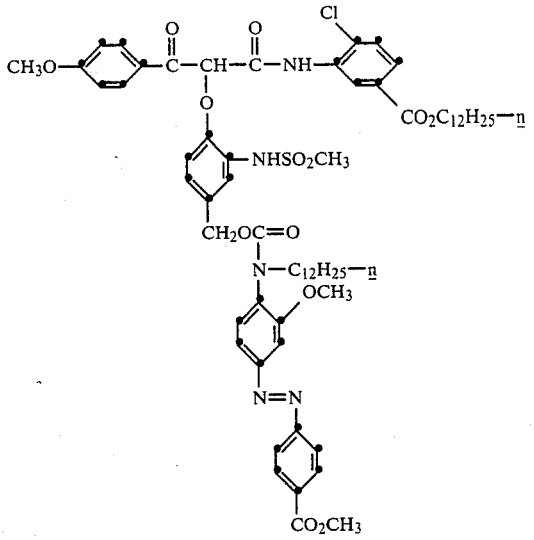
EXAMPLE 52
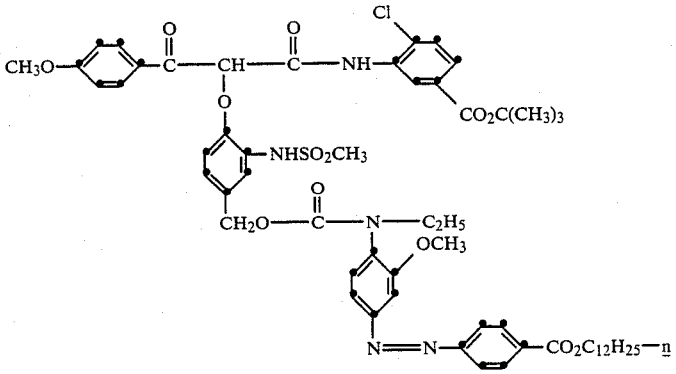
EXAMPLE 54
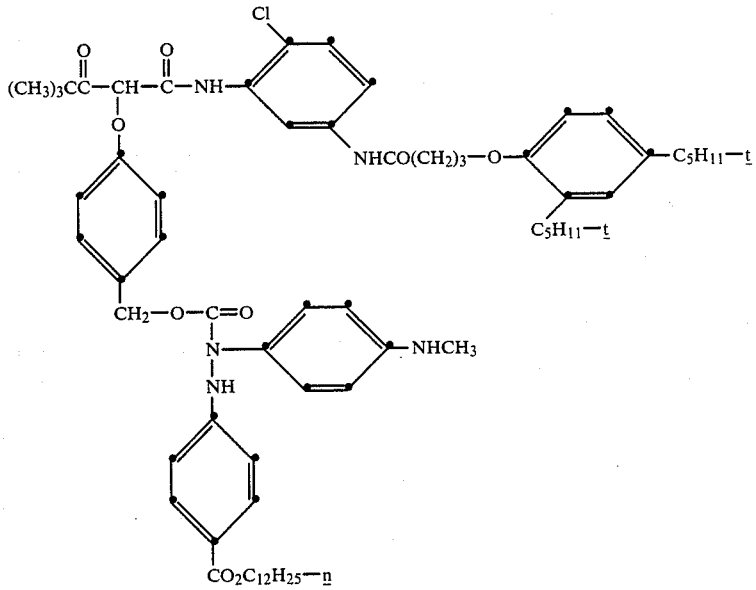

EXAMPLE 55
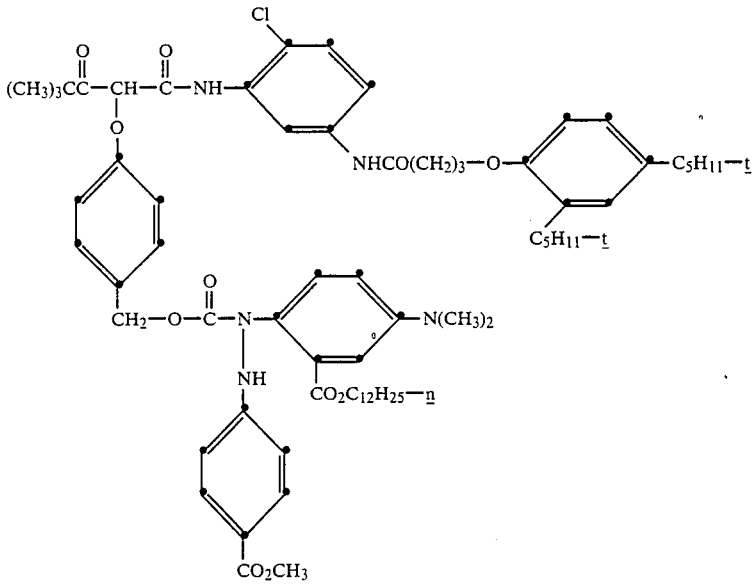
EXAMPLE 56
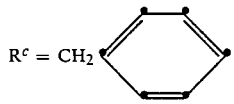
EXAMPLE 57
$R^c = H$
EXAMPLE 58
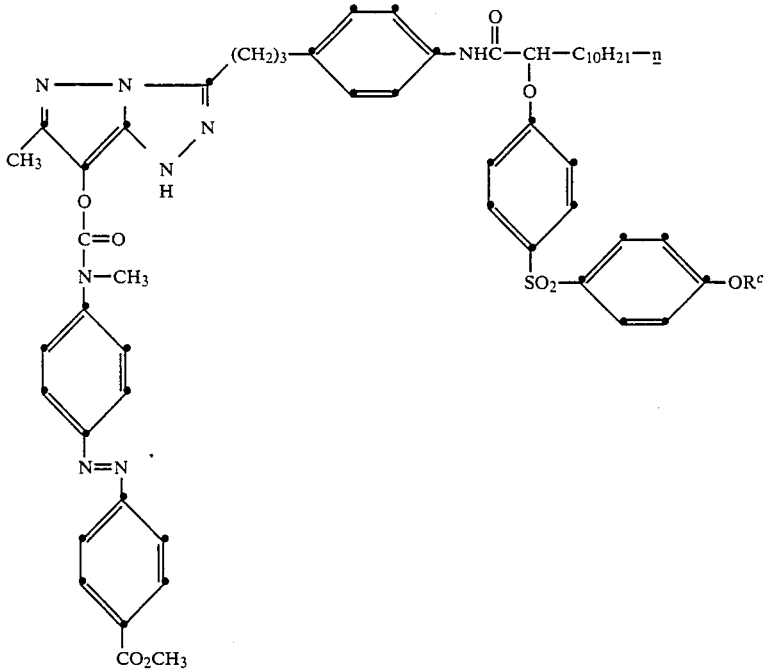
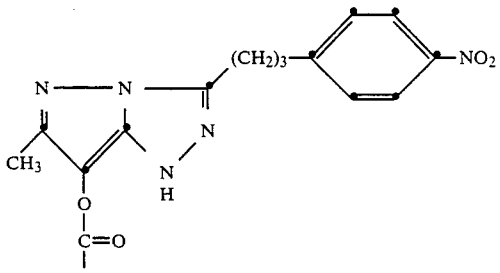

-continued
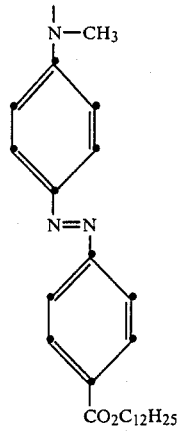
EXAMPLE 59
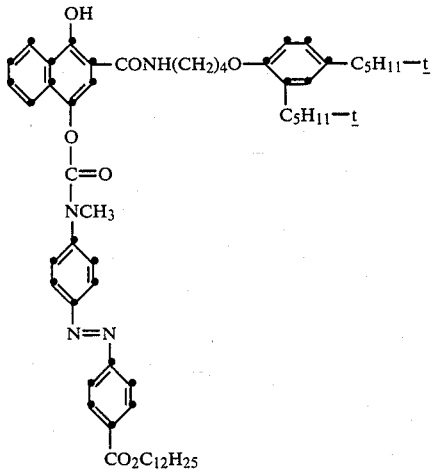
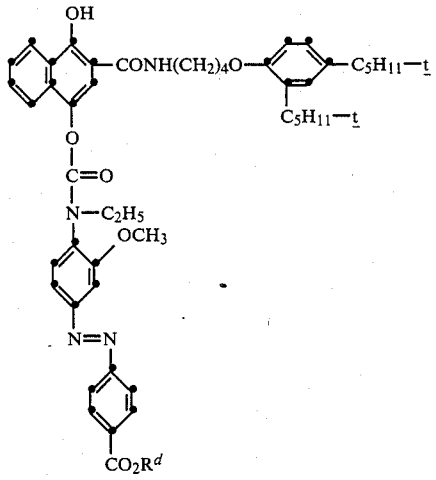
EXAMPLE 60
$R^d = CH_3$
EXAMPLE 61
$R^d = C_2H_5$
EXAMPLE 62
$R^d$ = n-Propyl
EXAMPLE 63
$R^d$ = n-Butyl
EXAMPLE 64
$R^d$ = n-Hexyl
EXAMPLE 65
$R^d$ = n-Dodecyl
EXAMPLE 66
$R^d$ = n-Octadecyl
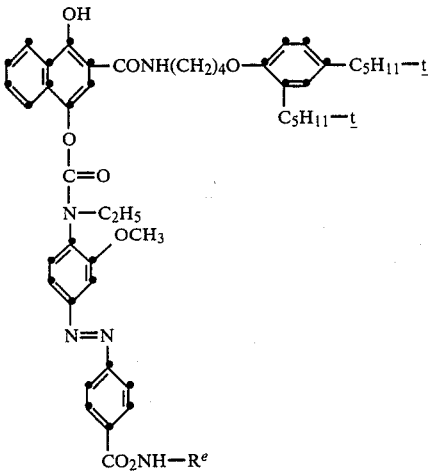
EXAMPLE 67
$R^e = CH_3$
EXAMPLE 68
$R^e$ = n-Hexyl
EXAMPLE 69
$R^e$ = n-Dodecyl
EXAMPLE 70
$R^e$ = n-Octadecyl
EXAMPLE 71

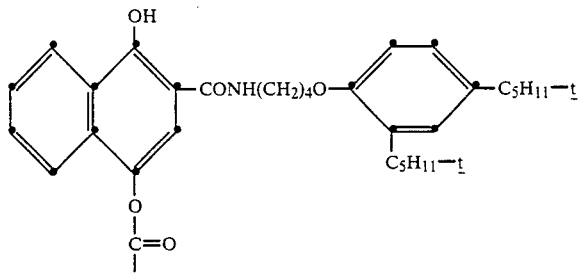

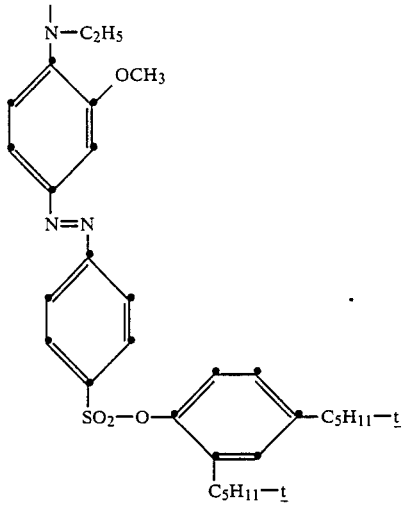

The invention has been described in detail with particular reference to preferred embodiments thereof, but it will be understood that variations and modifications can be effected within the spirit and scope of the invention.

What is claimed is:

1. A photographic element comprising a support bearing a silver halide photographic emulsion and a coupler having a coupling-off group bonded to the coupler at the coupling position wherein the coupling-off group is represented by the formula:

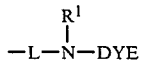

wherein

L is a linking group cleavable from

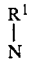

after coupling-off and contains —B— bonded to

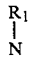

wherein —B— is

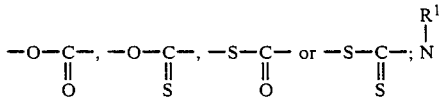

is a substituted nitrogen atom bonded to DYE that together with the substituted nitrogen atom is a releasable dye comprising an electrically neutral chromophore; wherein the linking group enables a spectral shift in absorption of DYE.

2. A photographic element as in claim 1 wherein the linking group is represented by the formula:

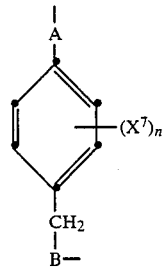

wherein

A is O, S, or sulfonamido;

B is

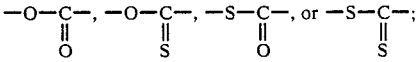

$X^7$ is a substituent; and n is 0, 1, 2, 3 or 4.

3. A photographic element as in claim 1 wherein the linking group is represented by the formula:

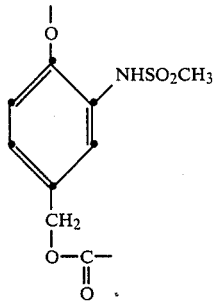

4. A photographic element as in claim 1 wherein the coupling-off group is represented by the formula:

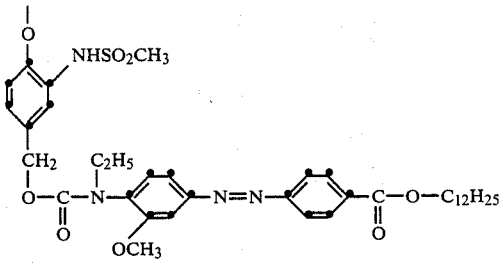

5. A photographic element as in claim 1 wherein

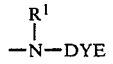

represents the atoms necessary to complete an azoaniline, methine or azamethine dye comprising an electrically neutral chromophore.

6. A photographic element as in claim 1 wherein the coupler is represented by the formula:

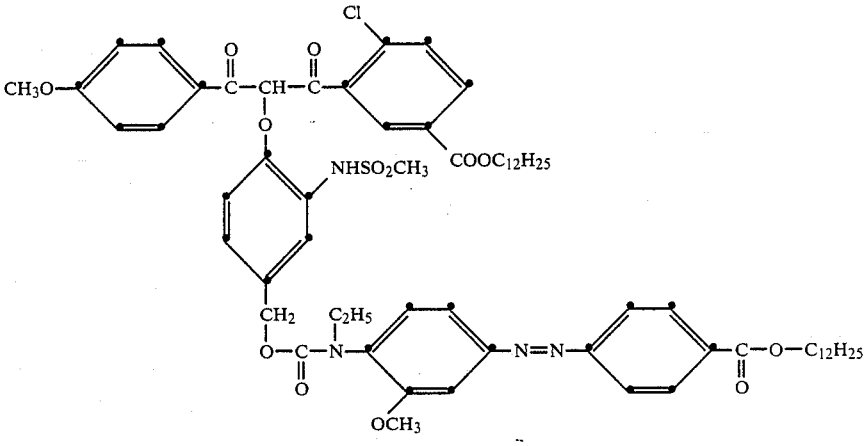

7. A photographic element as in claim 1 which comprises at least one blue-sensitive photographic silver halide emulsion layer containing at least one yellow image dye-forming coupler; at least one green-sensitive photographic silver halide emulsion layer containing at least one magenta image dye-forming coupler; and at least one red-sensitive photographic silver halide emulsion layer containing at least one cyan image dye-forming layer and wherein at least on of the image-dye forming couplers is a coupler as defined in claim 1.

8. A process of forming a photographic image which comprises developing an exposed photographic silver halide emulsion layer with a color developing agent in the presence of an image dye-forming coupler as defined in claim 1.

9. A process as in claim 8 wherein the coupling-off group is represented by the formula:

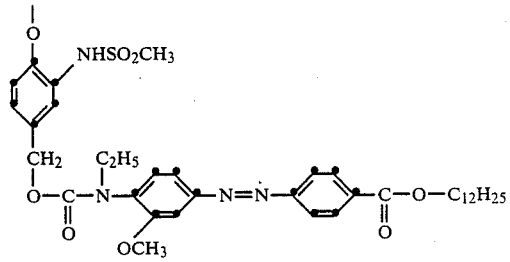

10. A process as in claim 9 wherein the image dye-forming coupler is:

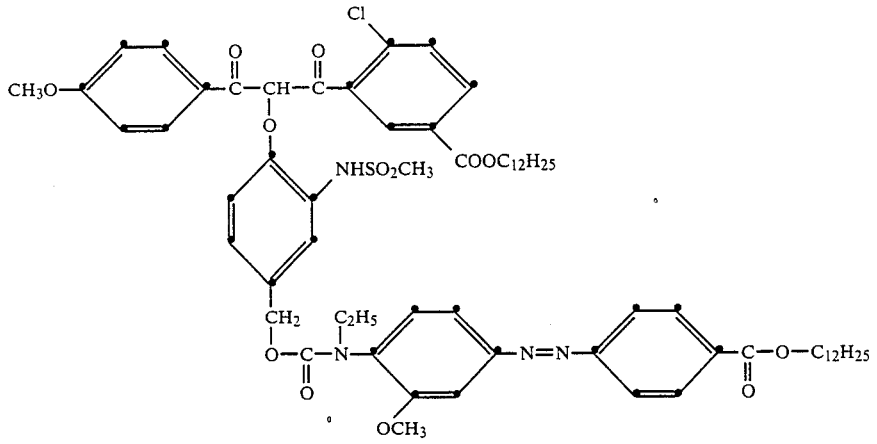
Cl
O
O
CH3O
C
CH
C
O
NHSO2CH3
COOC12H25
CH2
C2H5
O
C
N
N=N
C
O
C12H25
O
O
OCH3
* * * * *

UNITED STATES PATENT AND TRADEMARK OFFICE

CERTIFICATE OF CORRECTION

PATENT NO. : 4,840,884

DATED : June 20, 1989

INVENTOR(S) : Mooberry et al

It is certified that error appears in the above-identified patent and that said Letters Patent is hereby corrected as shown below:

Column 1, line 58, "diang" should read -- ding --;

Column 1, line 67, after "coupling-off" insert -- group --;

Column 2, line 47, "suchas" should read -- such as --;

Column 3, line 61, "increases" should read -- increased --;

Column 14, line 51, "elemet" should read -- element --;

UNITED STATES PATENT AND TRADEMARK OFFICE

CERTIFICATE OF CORRECTION

PATENT NO. : 4,840,884

DATED : June 20 , 1989

INVENTOR(S) : Mooberry et al

It is certified that error appears in the above-identified patent and that said Letters Patent is hereby corrected as shown below:

Column 51, lines 49-67, EXAMPLE 37, the structure should read

--

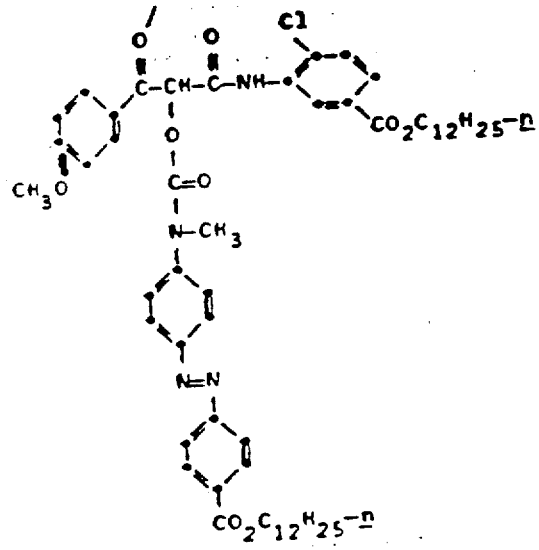

--

Signed and Sealed this

Second Day of July, 199

*Attest:*

HARRY F. MANBECK, JR.

*Attesting Officer*

*Commissioner of Patents and Trademarks*